US009829817B2

(12) United States Patent
Takatsuna

(10) Patent No.: US 9,829,817 B2
(45) Date of Patent: Nov. 28, 2017

(54) DEVELOPER, IMAGE FORMING APPARATUS, AND IMAGE FORMING METHOD

(71) Applicant: KYOCERA Document Solutions Inc., Osaka (JP)

(72) Inventor: Toru Takatsuna, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/451,574

(22) Filed: Mar. 7, 2017

(65) Prior Publication Data

US 2017/0261875 A1 Sep. 14, 2017

(30) Foreign Application Priority Data

Mar. 9, 2016 (JP) ..... 2016-045784

(51) Int. Cl.

| | |
|---|---|
| ***G03G 9/08*** | (2006.01) |
| ***G03G 9/087*** | (2006.01) |
| ***G03G 15/08*** | (2006.01) |
| ***G03G 9/135*** | (2006.01) |
| ***G03G 9/113*** | (2006.01) |

(52) U.S. Cl.

CPC ..... *G03G 9/08766* (2013.01); *G03G 9/0821* (2013.01); *G03G 9/1134* (2013.01); *G03G 9/135* (2013.01); *G03G 15/0822* (2013.01)

(58) Field of Classification Search

CPC .... G03G 9/1134; G03G 9/135; G03G 9/0821; G03G 9/0823; G03G 15/0822

USPC ..... 430/111.1, 111.4, 111.41

See application file for complete search history.

(56) References Cited

FOREIGN PATENT DOCUMENTS

JP 2003-149857 A 5/2003

*Primary Examiner* — Mark A Chapman

(74) *Attorney, Agent, or Firm* — Studebaker & Brackett PC

(57) ABSTRACT

A developer includes a toner including toner particles and a carrier including carrier particles. The carrier particles each include a carrier core and a carrier coating layer covering the carrier core. The carrier coating layer contains a fluorine-containing resin. The toner particles each include a toner mother particle and resin particles located on a surface of the toner mother particle. The resin particles have a number average primary particle diameter of at least 70 nm and no greater than 200 nm. A dispersion obtained by dispersing 0.1 g of the resin particles in 100 mL of distilled water has an electrical conductivity of at least 2.5 μS/m and no greater than 6.0 μS/m. A degree of aggregation $Y_{160}$ of the resin particles represented by expression (1) "$Y_{160}=100\times M_{160A}/M_{160B}$" is at least 15% by mass and no greater than 40% by mass.

9 Claims, 4 Drawing Sheets

DEVELOPER, IMAGE FORMING APPARATUS, AND IMAGE FORMING METHOD

INCORPORATION BY REFERENCE

The present application claims priority under 35 U.S.C. §119 to Japanese Patent Application No. 2016-045784, filed Mar. 9, 2016. The contents of this application are incorporated herein by reference in their entirety.

BACKGROUND

The present disclosure relates to a developer (particularly, two-component developer), an image forming apparatus, and an image forming method.

An image forming apparatus includes an image bearing member. A toner included in a developer is supplied to an electrostatic latent image formed on the surface of the image bearing member. Through the above, the electrostatic latent image is developed into a toner image. The toner image is then transferred from the image bearing member to a transfer target. A toner remaining on the image bearing member after the transfer may cause insulation breakdown in a photosensitive layer included in the image bearing member. In a situation in which the insulation breakdown occurs in the photosensitive layer, black spots (so-called leak black spots) are generated in a formed image. Therefore, various studies have been made to inhibit occurrence of the insulation breakdown in the photosensitive layer.

In an example of a magnetic toner, the magnetic toner contains at least a binder resin, a wax component (a releasing agent), and a magnetic substance. Free particles of the magnetic substance are present in the magnetic toner at a rate of at least 70 particles and no greater than 500 particles per 10,000 toner particles.

SUMMARY

A developer according to the present disclosure includes a toner and a carrier. The carrier includes a plurality of carrier particles. The carrier particles each include a carrier core and a carrier coating layer covering the carrier core. The carrier coating layer contains a fluorine-containing resin. The toner includes a plurality of toner particles. The toner particles each include a toner mother particle and a plurality of resin particles located on a surface of the toner mother particle. The resin particles have a number average primary particle diameter of at least 70 nm and no greater than 200 nm. A dispersion obtained by dispersing 0.1 g of the resin particles in 100 mL of distilled water has an electrical conductivity of at least 2.5 μS/m and no greater than 6.0 μS/m. A degree of aggregation $Y_{160}$ of the resin particles represented by expression (1) shown below is at least 15% by mass and no greater than 40% by mass.

$$Y_{160}=100\times M_{160A}/M_{160B} \quad (1)$$

In the expression (1), $M_{160B}$ represents a mass of the resin particles to which a pressure of 0.1 kgf/mm$^2$ has been applied at a temperature of 160° C. for five minutes. $M_{160A}$ represents a mass of the resin particles that remain on a sieve having openings of 75 μm after being subjected to the application of the pressure of 0.1 kgf/mm$^2$ at the temperature of 160° C. for five minutes and then separated using the sieve.

An image forming apparatus according to the present disclosure includes: an image bearing member that bears a toner image; and a development section that performs development of an electrostatic latent image formed on a surface of the image bearing member into the toner image by supplying the toner included in the developer to the electrostatic latent image. The image bearing member is an amorphous silicon photosensitive member.

An image forming method according to the present disclosure includes developing, by a development section, an electrostatic latent image formed on a surface of an image bearing member into a toner image by supplying the toner included in the developer to the electrostatic latent image. The image bearing member is an amorphous silicon photosensitive member.

DETAILED DESCRIPTION

Figure 1:
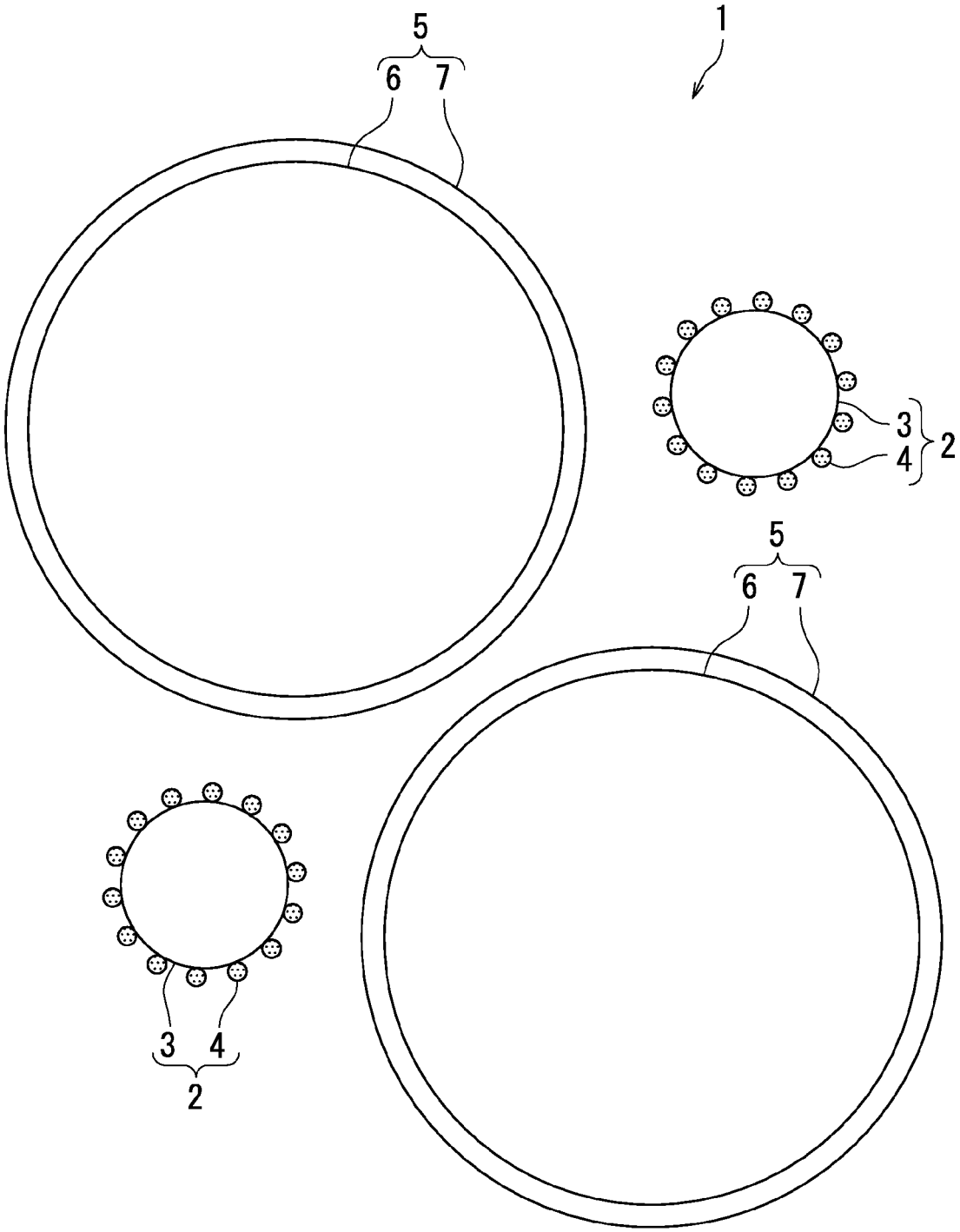
FIG. 1 is a cross-sectional view illustrating a developer according to an embodiment of the present disclosure.

The following describes an embodiment of the present disclosure. Note that the present disclosure is in no way limited to the embodiment described below. Various alterations may be appropriately made within the scope of objects of the present disclosure. Note that some overlapping explanations may be appropriately omitted, but such omission is not intended to limit the gist of the disclosure. The drawings schematically illustrate elements of configuration in order to facilitate understanding. Properties of elements of configuration illustrated in the drawings, such as thicknesses, lengths, numbers, shapes, and dimensions thereof, are merely examples and are not intended as specific limitations.

Note that in the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

An average value used herein refers to a number average value unless otherwise stated. When evaluation values (for example, values indicating shapes or properties) pertaining to powders (for example, toner, toner particles 2, toner mother particles 3, resin particles 4, carrier particles 5, and carrier cores 6 described later) are given, such evaluation values also refers to number average values unless otherwise stated. A number average value is obtained by adding up values measured with respect to an appropriate number of measurement targets and dividing the sum by the number. A particle diameter of a powder refers to an equivalent circle diameter of a primary particle measured using an electron microscope unless otherwise stated. The equivalent circle diameter is the diameter of a circle having the same area as a projected area of the particle. A volume median diameter $D_{50}$ refers to a median diameter calculated in terms of volume by a coulter counter method. The volume median diameter $D_{50}$ of a sample is measured using for example a precision particle size distribution analyzer ("Coulter Counter Multisizer 3" manufactured by Beckman Coulter, Inc.).

<1. Developer>

The present embodiment relates to a developer 1. The following describes the developer 1 of the present embodiment with reference to FIG. 1. FIG. 1 is a cross-sectional view illustrating the developer 1 of the present embodiment. The developer 1 includes a toner and a carrier. The toner includes a plurality of toner particles 2. The toner is a mass (powder) of a number of toner particles 2. The carrier includes a plurality of carrier particles 5. The carrier is a mass (powder) of a number of carrier particles 5.

<1-1. Toner Particle>

The toner particle 2 includes a toner mother particle 3 and a plurality of resin particles 4. The plurality of resin particles 4 are located on the surface of the toner mother particle 3. Note that in FIG. 1, the resin particles 4 are illustrated with dots, and some reference numerals are omitted.

<1-1-1. Resin Particle>

The resin particles 4 as external additive particles are located on the surface of the toner mother particle 3. The resin particles 4 serve for example as spacer particles. In a situation in which the resin particles 4 have a specific number average primary particle diameter, a specific electrical conductivity, and a specific degree of aggregation $Y_{160}$, occurrence of insulation breakdown in a photosensitive layer 112 of an image bearing member 11 can be inhibited to prevent generation of leak black spots in a formed image.

In order to facilitate understanding, insulation breakdown in the photosensitive layer 112 (see FIGS. 3A and 3B) will be initially described. The following describes as an example, a situation in which an image is formed using an image forming apparatus 100 (see FIG. 2) including the image bearing member 11 (for example, a photosensitive member, see FIG. 2) and a cleaning section 16 (for example, a cleaning blade, see FIG. 2). After transfer of a toner, a residual toner on the image bearing member 11 is cleaned by the cleaning section 16. The image bearing member 11 is in contact with an end (a ridge) of the cleaning section 16. The residual toner on the image bearing member 11 tends to accumulate in a region of contact between the image bearing member 11 and the end of the cleaning section 16. The accumulating toner may be excessively charged upon friction by the cleaning section 16. In a situation in which a charge amount of the toner exceeds a threshold value, the excessively charged toner discharges electricity toward a local area of the image bearing member 11 (so-called one point discharge). As a result, insulation breakdown is caused in the photosensitive layer 112 of the image bearing member 11. The insulation breakdown in the photosensitive layer 112 tends to be caused more easily in a situation in which the image bearing member 11 is an amorphous silicon photosensitive member than in a situation in which the image bearing member 11 is an organic photosensitive member. The inventor of the present disclosure found that it is effective to control the number average primary particle diameter, the electrical conductivity, and the degree of aggregation $Y_{160}$ of the resin particles 4 in order to inhibit occurrence of the insulation breakdown in the photosensitive layer 112. The following describes the number average primary particle diameter, the electrical conductivity, and the degree of aggregation $Y_{160}$ of the resin particles 4.

(Number Average Primary Particle Diameter)

The number average primary particle diameter of the resin particles 4 is at least 70 nm and no greater than 200 nm. In a situation in which the number average primary particle diameter of the resin particles 4 is less than 70 nm, the resin particles 4 do not sufficiently serve as spacer particles. Therefore, particularly in a situation in which images having low coverage rates are successively formed, the toner staying in a development section 14 (see FIG. 2) of the image forming apparatus 100 for a long period of time tends to be deteriorated. As a result, the toner cannot be charged to a desired potential, resulting in reduction of an image density of a formed image. In a situation in which the number average primary particle diameter of the resin particles 4 is greater than 200 nm, the resin particles 4 tend to be detached from the toner mother particle 3. Therefore, insulation breakdown in the image bearing member 11 tends to be caused. As a result, leak black spots are generated in a formed image. Also, fluidity of the toner is considered to decrease in a situation in which the number average primary particle diameter of the resin particles 4 is greater than 200 nm.

The number average primary particle diameter of the resin particles 4 can be controlled by for example changing one or both of a reaction time and stirring conditions at the time of reaction between raw materials of the resin particles 4. For example, the number average primary particle diameter of the resin particles 4 increases as the reaction time increases. The number average primary particle diameter of the resin particles 4 is measured according to the method described further below in the Examples or according to an alternative thereof.

(Electrical Conductivity)

A dispersion obtained by dispersing 0.1 g of the resin particles 4 in 100 mL of distilled water has an electrical conductivity of at least 2.5 μS/m and no greater than 6.0 μS/m. The electrical conductivity of the dispersion of the resin particles 4 is preferably at least 3.0 μS/m and no greater than 5.0 μS/m. In a situation in which the electrical conductivity of the dispersion of the resin particles 4 is less than 2.5 μS/m, electrical charge of the resin particles 4 is difficult to dissipate. Therefore, when the toner particle 2 including the resin particles 4 is subjected to friction by the cleaning section 16 on the image bearing member 11, the toner particle 2 may be excessively charged, resulting in occurrence of the insulation breakdown in the image bearing member 11. As a result, leak black spots are generated in a formed image. In a situation in which the electrical conductivity of the dispersion of the resin particles 4 is greater than 6.0 μS/m, a component of the resin particles 4 such as an emulsifier may exude and adhere to the carrier particle 5. As a result, the carrier particle 5 cannot charge the toner particle 2 sufficiently and fogging may be caused in a formed image. Note that the electrical conductivity is in inverse proportion to the electric resistance. Therefore, the electrical conductivity of the dispersion of the resin particles 4 serves as an index that indicates the electric resistance of the resin particles 4. A difference in the electrical conductivity of the dispersion of the resin particles 4 tends to be greater than a difference in the electric resistance of the resin particles 4. Therefore, it is thought that the electric resistance of the resin particles 4 can be controlled with high precision by controlling the electrical conductivity of the dispersion of the resin particles 4. In a situation in which the electrical conductivity of the dispersion of the resin particles 4 is at least 2.5 μS/m and no greater than 6.0 μS/m, the electric resistance of the resin particles 4 is relatively low.

The electrical conductivity of the dispersion of the resin particles 4 can be controlled by for example changing an additive amount of the emulsifier (dispersant) in production of the resin particles 4. The electrical conductivity of the dispersion of the resin particles 4 tends to increase as the additive amount of the emulsifier relative to an additive amount of a monomer (for example, an acrylic acid or an acrylic acid derivative) for forming the resin particles 4 increases. The electrical conductivity of the dispersion of the resin particles 4 can also be controlled by changing conditions for washing the resin particles 4 to change an amount of the emulsifier remaining on the surfaces of the resin particles 4. The electrical conductivity of the dispersion of the resin particles 4 is measured by dispersing 0.1 g of the resin particles 4 in 100 mL of distilled water. The electrical conductivity of the dispersion of the resin particles 4 is measured according to the method described further below in the Examples or according to an alternative thereof.

(Degree of Aggregation)

The resin particles 4 have a degree of aggregation $Y_{160}$ of at least 15% by mass and no greater than 40% by mass. The degree of aggregation $Y_{160}$ of the resin particles 4 is preferably at least 15% by mass and no greater than 30% by mass. The degree of aggregation $Y_{160}$ of the resin particles is represented by expression (1) shown below. In the expression (1), $M_{160B}$ represents a mass of the resin particles 4 to which a pressure of 0.1 kgf/mm$^2$ has been applied at a temperature of 160° C. for five minutes. Further, $M_{160A}$ represents a mass of the resin particles 4 that remain on a sieve having openings of 75 μm (a plain-woven sieve of 200 mesh specified in JIS Z8801-1 and having a wire diameter of 50 μm and square openings) after being subjected to the application of the pressure of 0.1 kgf/mm$^2$ at the temperature of 160° C. for five minutes and then separated using the sieve $$Y_{160}=100\times M_{160A}/M_{160B} \quad (1)$$

In other words, $M_{160B}$ represents a mass of pressure-applied resin particles obtained by applying a pressure of 0.1 kgf/mm$^2$ to the resin particles 4 at a temperature of 160° C. for five minutes. $M_{160A}$ represents a mass of the pressure-applied resin particles that remain on a sieve having openings of 75 μm after being separated using the sieve.

In a situation in which the degree of aggregation $Y_{160}$ of the resin particles 4 is less than 15% by mass, hardness of the resin particles 4 increases and the toner particle 2 including the resin particles 4 tends to be subjected to friction by the cleaning section 16 on the image bearing member 11. Therefore, the resin particles 4 tend to be excessively charged, resulting in occurrence of the insulation breakdown in the image bearing member 11. As a result, leak black spots are generated in a formed image.

In a situation in which the degree of aggregation $Y_{160}$ of the resin particles 4 is greater than 40% by mass, the hardness of the resin particles 4 decreases and the resin particles 4 detached from the toner mother particle 3 to the image bearing member 11 tend to be thermally compressed in a region of contact between the image bearing member 11 and the cleaning section 16. Therefore, the resin particles 4 tend to stick to the image bearing member 11. As a result, white spots are generated in a formed image. In a situation in which the resin particles 4 are thermally compressed in the region of contact between the image bearing member 11 and the cleaning section 16, energy applied to the resin particles 4 is supposed to be equivalent to energy applied to the resin particles 4 by a pressure of 0.1 kgf/mm$^2$ at a temperature of 160° C. for five minutes. Therefore, in order to inhibit aggregation of the resin particles 4 upon thermal compression thereof, it is thought important to control the degree of aggregation $Y_{160}$ of the resin particles 4 at the temperature of 160° C. This is because even in a situation in which plural types of resin particles have the same degree of aggregation within a temperature range below 160° C., degrees of aggregation $Y_{160}$ of the plural types of resin particles at the temperature of 160° C. are different from each other.

In a situation in which the degree of aggregation $Y_{160}$ of the resin particles 4 is greater than 40% by mass, the resin particles 4 tend to adhere to the carrier particle 5. Further, a fluorine-containing resin is contained in a carrier coating layer 7 of the carrier particle 5 included in the developer 1 of the present embodiment. The carrier coating layer 7 as above tends to have low hardness. Therefore, scraping of the carrier coating layer 7 and adhesion of the resin particles 4 to the carrier coating layer 7 tend to be caused by contact between the carrier particle 5 and the toner particle 2 including the resin particles 4.

The degree of aggregation $Y_{160}$ of the resin particles 4 can be controlled by for example changing an additive amount of a cross-linking agent in production of the resin particles 4. Cross-linking reaction proceeds more easily as the additive amount of the cross-linking agent increases. As a result, hardness of the resin particles 4 increases and the degree of aggregation $Y_{160}$ of the resin particles 4 tends to decrease. Also, the cross-linking reaction proceeds more easily as purity of the cross-linking agent increases. As a result, hardness of the resin particles 4 increases and the degree of aggregation $Y_{160}$ of the resin particles 4 tends to decrease.

The degree of aggregation $Y_{160}$ of the resin particles 4 is measured according to the method described further below in the Examples or according to an alternative thereof. Note that even after external addition of the resin particles 4, the degree of aggregation $Y_{160}$ of the resin particles 4 can be measured by separating the resin particles 4 from the toner particle 2. The following is an example of a method for separating the resin particles 4 from the toner particle 2. Specifically, a toner is added to an aqueous solution containing a surfactant to obtain a mixture. The mixture is dispersed using an ultrasonic disperser. The resultant dispersion is filtered and a filtrate is collected. The collected filtrate is centrifuged using a centrifugal separator. A supernatant including the resin particles 4 is collected. The supernatant is subjected to pressure filtration to obtain a wet cake of the resin particles 4. The obtained wet cake of the resin particles 4 is dried in vacuum to obtain dry resin particles 4.

Examples of resins that form the resin particles 4 include styrene-acrylic acid-based resins, styrene-based resins, vinyl resins, polyester resins, urethane resins, acrylonitrile resins, and acrylamide resins. The styrene-based resins and the styrene-acrylic acid-based resins are preferable, and the styrene-acrylic acid-based resins are more preferable since the degree of aggregation $Y_{160}$, the electrical conductivity, and the number average primary particle diameter of the resin particles 4 can be easily controlled within desired ranges in a situation in which the resin particles 4 are formed from these resins. The resin particles 4 can be obtained through polymerization or copolymerization of monomers for forming the resin particles 4.

A styrene-based resin can be obtained through for example polymerization or copolymerization of at least one styrene-based monomer. A styrene-based monomer is used as a monomer for forming the resin particles 4. The styrene-based monomer is styrene or a styrene derivative. Examples of the styrene-based monomer include styrene, α-methylstyrene, p-chlorostyrene, 3,4-dichlorostyrene, p-phenylstyrene, p-ethylstyrene, 2,4-dimethylstyrene, and p-tert-butylstyrene.

A styrene-acrylic acid-based resin can be obtained through for example copolymerization of at least one type of styrene-based monomer and at least one type of acrylic acid-based monomer. The styrene-based monomer and the acrylic acid-based monomer are used as monomers for forming the resin particles 4. The styrene-based monomer is styrene or a styrene derivative. Examples of the styrene-based monomer for forming the styrene-acrylic acid-based resin is the same as the examples of the styrene-based monomers for forming the styrene-based resin. Among the examples of the styrene-based monomers, styrene is preferable. The acrylic acid-based monomer is an acrylic acid or an acrylic acid derivative. Examples of the acrylic acid-based monomer include a methacrylic acid, methacrylic acid alkyl esters, an acrylic acid, and acrylic acid alkyl esters. Examples of the methacrylic acid alkyl esters include methyl methacrylate, ethyl methacrylate, butyl methacrylate, isopropyl methacrylate, and 2-ethylhexyl methacrylate. Examples of the acrylic acid alkyl esters include methyl acrylate, ethyl acrylate, iso-propyl acrylate, butyl acrylate, octyl acrylate, and 2-ethylhexyl acrylate. Among the examples of the acrylic acid-based monomer, the methacrylic acid alkyl esters are preferable, and butyl methacrylate is more preferable. The amount of the styrene-based monomer is preferably at least 5 parts by mass and no greater than 50 parts by mass, and more preferably at least 10 parts by mass and no greater than 30 parts by mass relative to 100 parts by mass of the acrylic acid-based monomer (acrylic acid or acrylic acid derivative).

A cross-linking agent may be used for formation of the styrene-acrylic acid-based resin. Through use of the cross-linking agent, a degree of cross-linking of the resin can be increased and the degree of aggregation $Y_{160}$ of the resin particles 4 can be reduced. Examples of the cross-linking agent include compounds having at least two (preferably two or three, more preferably two) vinyl groups. Specific examples of the compounds having at least two vinyl groups include divinylbenzene, ethylene glycol diacrylate, ethylene glycol dimethacrylate, polyethylene glycol diacrylate, polyethylene glycol dimethacrylate, trimethylolpropane triacrylate, and trimethylolpropane trimethacrylate. Among the above compounds, divinylbenzene is preferable as the cross-linking agent.

The amount of the cross-linking agent is preferably at least 35 parts by mass and no greater than 85 parts by mass relative to 100 parts by mass of the acrylic acid-based monomer (acrylic acid or acrylic acid derivative) since the degree of aggregation $Y_{160}$ of the resin particles 4 can be easily controlled to a desired value in a situation in which the amount of the cross-linking agent is within this range.

Purity of the cross-linking agent used for formation of the styrene-acrylic acid-based resin is preferably at least 80%, and more preferably at least 98%. In a situation in which the purity of the cross-linking agent is within the above range, the degree of aggregation $Y_{160}$ of styrene-acrylic acid-based resin particles to be formed can be reduced. The purity of the cross-linking agent is calculated for example using $^1$H-NMR (proton nuclear magnetic resonance spectrometer, "600CSL" manufactured by Agilent Technologies Japan, Ltd.) from a ratio between a peak unique to the cross-linking agent and peaks resulting from impurities.

The resin particles 4 preferably contain a copolymer of an acrylic acid-based monomer, a styrene-based monomer, and a cross-linking agent since the degree of aggregation $Y_{160}$, the electrical conductivity, and the number average primary particle diameter of the resin particles 4 can be easily controlled within desired ranges in a situation in which the resin particles 4 are formed from such a copolymer. For the same reason, the resin particles 4 more preferably contain a copolymer of an acrylic acid alkyl ester or a methacrylic acid alkyl ester (more preferably butyl methacrylate), styrene, and a compound having at least two (preferably two or three, more preferably two) vinyl groups.

Only one type of resin particles 4 may be used, or at least two types of resin particles 4 may be used in combination. The amount (additive amount) of the resin particles 4 is preferably at least 0.05 parts by mass and no greater than 10.0 parts by mass, and more preferably at least 0.5 parts by mass and no greater than 2.0 parts by mass relative to 100.0 parts by mass of the toner mother particles 3.

(Other External Additive)

An external additive other than the resin particles 4 (other external additive) may be further present on the surface of the toner mother particle 3 as necessary. Examples of the other external additive include silica and metal oxides. Specific examples of the metal oxides include alumina, titanium oxide, magnesium oxide, zinc oxide, strontium titanate, and barium titanate. The surface of the other external additive may be subjected to hydrophobic treatment. Only one other external additive may be used, or at least two other external additives may be used in combination.

The number average particle diameter of the other external additive is preferably at least 1 nm and no greater than 1 μm, and more preferably at least 1 nm and no greater than 50 nm. The amount of use of the other external additive is preferably at least 0.5 parts by mass and no greater than 10.0 parts by mass relative to 100.0 parts by mass of the toner mother particles.

<1-1-2. Toner Mother Particle>

The toner mother particle 3 may contain for example at least one of a binder resin, a colorant, a releasing agent, and a charge control agent. An unnecessary component may be omitted in accordance with intended use of the toner. Note that the toner mother particle 3 may be encapsulated. An encapsulated toner mother particle 3 includes for example a toner core having the same structure and components as the toner mother particle described below, and a shell layer (capsule layer) formed on the surface of the toner core.

(Binder Resin)

The binder resin is not particularly limited as long as it is a binder resin used for preparation of a toner. A thermoplastic resin is preferable as the binder resin in order to improve fixability of the toner. Examples of the thermoplastic resin include acrylic acid-based resins, styrene-acrylic acid-based resins, polyester resins, polyamide resins, urethane resins, and vinyl alcohol-based resins. The polyester resins are particularly preferable as the binder resin in order to improve dispersibility of a colorant, chargeability of the toner, and fixability of the toner to recording medium (for example, paper). The following describes the polyester resins.

A polyester resin can be obtained through for example condensation polymerization or co-condensation polymerization of an alcohol and a carboxylic acid.

Examples of alcohols that can be used for synthesis of the polyester resin include dihydric alcohols and tri- or higher-hydric alcohols.

Examples of the dihydric alcohols include diols and bisphenols. Examples of the diols include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol. Examples of the bisphenols include bisphenol A, hydrogenated bisphenol A, bisphenol A ethylene oxide adduct (polyoxyethylene (2.2)-2,2-bis(4-hydroxyphenyl)propane), and bisphenol A propylene oxide adduct.

Examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of carboxylic acids that can be used for the synthesis of the polyester resin include dibasic carboxylic acids and tri- or higher-basic carboxylic acids.

Examples of the dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid, and alkenyl succinic acid. Examples of the alkyl succinic acid include n-butylsuccinic acid, isobutylsuccinic acid, n-octylsuccinic acid, n-dodecylsuccinic acid, and isododecylsuccinic acid. Examples of the alkenyl succinic acid include n-butenylsuccinic acid, isobutenylsuccinic acid, n-octenylsuccinic acid, n-dodecenylsuccinic acid, and isododecenylsuccinic acid.

Examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Only one alcohol may be used, or at least two alcohols may be used in combination. Also, only one carboxylic acid may be used, or at least two carboxylic acids may be used in combination. Further, a carboxylic acid may be used in the form of an ester-forming derivative. Examples of the ester-forming derivative include acid halides, acid anhydrides (for example, trimellitic anhydride), and lower alkyl esters. The term "lower alkyl" used herein refers to an alkyl group having 1 to 6 carbon atoms.

In a situation in which a polyester resin constitutes the binder resin, the polyester resin constitutes preferably at least 70% by mass of the binder resin, more preferably at least 80% by mass, particularly preferably at least 90% by mass, and most preferably 100% by mass.

The softening point (Tm) of the binder resin is preferably at least 60° C. and no greater than 150° C. In order that the binder resin has the softening point within the above range, a plurality of resins having softening points different from each other may be used in combination as the binder resin.

The acid value of the binder resin is preferably at least 1 mgKOH/g and no greater than 30 mgKOH/g. The acid value of the binder resin is measured by for example a method described in Japanese Industrial Standards (JIS) K0070-1992.

The melting point (Mp) of the binder resin is preferably at least 50° C. and no greater than 100° C. In a situation in which the melting point of the binder resin is within the above range, the toner tends to have low-temperature fixability, hot offset resistance, and high-temperature preservability. The melting point of the binder resin is measured for example using a differential scanning calorimeter ("DSC-6220" manufactured by Seiko Instruments Inc.). Specifically, a measurement sample (binder resin) is placed in an aluminum pan. The aluminum pan is set in a measurement section of the differential scanning calorimeter. An empty aluminum pan is used as a reference. The temperature of the sample is increased to 170° C. at a rate of 10° C./minute from a measurement starting temperature of 30° C. The melting point of the measurement sample is determined to be a temperature corresponding to a maximum of enthalpy of fusion observed while increasing the temperature.

(Colorant)

A known pigment or dye that matches the color of the toner is used as the colorant. The amount of the colorant is preferably at least 1 part by mass and no greater than 30 parts by mass relative to 100 parts by mass of the binder resin.

A black colorant is used for a black toner. Examples of the black colorant include carbon black. Also, a black colorant that has been adjusted to a black color using a yellow colorant, a magenta colorant, and a cyan colorant described below may be used.

A yellow colorant is used for a yellow toner. Examples of the yellow colorant include condensed azo compounds, isoindolinone compounds, anthraquinone compounds, azo metal complexes, methine compounds, and arylamide compounds. More specific examples of the yellow colorant include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

A magenta colorant is used for a magenta toner. Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. More specific examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

A cyan colorant is used for a cyan toner. Examples of the cyan colorant include copper phthalocyanine, copper phthalocyanine derivatives, anthraquinone compounds, and basic dye lake compounds. More specific examples of the cyan colorant include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The releasing agent is used for example in order to improve fixability and offset resistance of the toner. In order to improve the fixability and offset resistance of the toner, the amount of the releasing agent is preferably at least 1 part by mass and no greater than 30 parts by mass relative to 100 parts by mass of the binder resin.

Examples of the releasing agent include aliphatic hydrocarbon waxes, oxides of aliphatic hydrocarbon waxes, plant waxes, animal waxes, mineral waxes, waxes having a fatty acid ester as a main component, and waxes in which a fatty acid ester has been partially or fully deoxidized. Examples of the aliphatic hydrocarbon waxes include ester wax, polyethylene wax (for example, low molecular weight polyethylene), polypropylene wax (for example, low molecular weight polypropylene), polyolefin copolymer, polyolefin wax, microcrystalline wax, paraffin wax, and Fischer-Tropsch wax. Examples of the oxides of aliphatic hydrocarbon waxes include polyethylene oxide wax and block copolymer of polyethylene oxide. Examples of the plant waxes include candelilla wax, carnauba wax, Japan wax, jojoba wax, and rice wax. Examples of the animal waxes include beeswax, lanolin, and spermaceti. Examples of the mineral waxes include ozokerite, ceresin, and petrolatum. Examples of the waxes having a fatty acid ester as a main component include montanic acid ester wax and castor wax. Examples of the waxes in which a fatty acid ester has been partially or fully deoxidized include deoxidized carnauba wax. Only one releasing agent may be used, or at least two releasing agents may be used in combination.

The melting point (fusing temperature) of the releasing agent is preferably at least 50° C. and no greater than 100° C. In a situation in which the melting point of the releasing agent is within the above range, low-temperature fixability of the toner containing the releasing agent is increased and occurrence of offset of the toner at a high temperature tends to be inhibited. The melting point of the releasing agent can be measured for example using a differential scanning calorimeter ("DSC-6220" manufactured by Seiko Instruments Inc.).

(Charge Control Agent)

The charge control agent is used in order to improve a charge level and a charge rise characteristic of the toner. Also, the charge control agent is used in order to obtain a toner having excellent durability and stability. The charge rise characteristic is an index that indicates whether or not the toner can be charged to a specific charge level within a short period of time.

A positively chargeable charge control agent is preferably used in a situation in which development is performed using a positively charged toner, whereas a negatively chargeable charge control agent is preferably used in a situation in which development is performed using a negatively charged toner. However, if sufficient chargeability is secured in the toner, there is no need to use a charge control agent.

Examples of the positively chargeable charge control agent include azine compounds, direct dyes made from azine compounds, nigrosine compounds, acid dyes made from nigrosine compounds, metal salts of naphthenic acids and metal salts of higher fatty acids, alkoxylated amines, alkylamides, and quaternary ammonium salts. Also, a resin containing a quaternary ammonium salt, a salt of carboxylic acid, or a carboxyl group can be used as the positively chargeable charge control agent. The quaternary ammonium salts and nigrosine compounds are preferable as the charge control agent in order to achieve rapid charge rise. Only one charge control agent may be used, or a plurality of charge control agents may be used in combination. The amount of the charge control agent is preferably at least 0.05 parts by mass and no greater than 5 parts by mass relative to 100 parts by mass of the binder resin.

<1-2. Carrier Particle>

The carrier particle 5 includes the carrier core 6 and the carrier coating layer 7. The carrier core 6 is covered by the carrier coating layer 7. The carrier coating layer 7 is located on the surface of the carrier core 6.

The number average primary particle diameter of the carrier particles 5 is preferably at least 20 μm and no greater than 120 μm, and more preferably at least 25 μm and no greater than 80 μm. The number average primary particle diameter of the carrier particles 5 is measured by for example the same method as the method for measuring the number average primary particle diameter of the resin particles 4.

In a situation in which the toner is used in a two-component developer, the amount of the toner is preferably at least 3% by mass and no greater than 20% by mass, and more preferably at least 5% by mass and no greater than 15% by mass relative to the mass of the two-component developer.

<1-2-1. Carrier Coating Layer>

The carrier coating layer 7 contains a fluorine-containing resin. Examples of the fluorine-containing resin include a copolymer of tetrafluoroethylene and hexafluoropropylene and a copolymer of tetrafluoroethylene and perfluoroalkyl vinyl ether (tetrafluoroethylene-perfluoroalkyl vinyl ether copolymer (PFA)). Perfluoroalkyl vinyl ether as a monomer is, for example, vinyl ether that has perfluoroalkyl having 1 to 20 carbon atoms, and more specifically, perfluorooctyl vinyl ether.

In a situation in which the fluorine-containing resin is a copolymer of perfluoroalkyl vinyl ether, the amount of perfluoroalkylate (for example, perfluorooctanoic acid) is preferably no greater than 100 ppm, and more preferably no greater than 10 ppm relative to the mass of perfluoroalkyl vinyl ether. The amount of perfluoroalkylate is measured using for example a high performance liquid chromatograph mass spectrometer (LC/MS).

The carrier coating layer 7 may further contain a resin other than the fluorine-containing resin (hereinafter may be referred to as the other resin). Examples of the other resin include acrylic acid-based polymers, styrene-based polymers, styrene-acrylic acid-based copolymers, olefin polymers, polyvinyl chlorides, polyvinyl acetates, polycarbonates, cellulose resins, polyester resins, unsaturated polyester resins, polyamide resins, polyamide-imide resins, polyimide resins, urethane resins, epoxy resins, silicone resins, fluororesins, phenolic resins, xylene resins, diallyl phthalate resins, polyacetal resins, and amino resins. Examples of the olefin polymers include polyethylene, chlorinated polyethylene, and polypropylene. Examples of the fluororesins include polytetrafluoroethylene, polychlorotrifluoroethylene, and polyvinylidene fluoride. Only one of the above resins may be used, or at least two of the above resins may be used in combination. The polyamide-imide resins are preferable as the other resins, and a copolymer of trimellitic anhydride and 4,4'-diaminodiphenylmethane is more preferable as the other resin.

In a situation in which the carrier coating layer 7 contains the fluorine-containing resin and the other resin, the amount of the fluorine-containing resin is preferably at least 1 part by mass and no greater than 9 parts by mass relative to 1 part by mass of the other resin. In a situation in which the amount of the fluorine-containing resin is at least 1 part by mass relative to 1 part by mass of the other resin, it is easy to charge the toner particle 2 sufficiently by friction with the carrier particle 5. In a situation in which the amount of the fluorine-containing resin is no greater than 9 parts by mass relative to 1 part by mass of the other resin, it is easy to disperse the fluorine-containing resin relative to the other resin.

The fluorine-containing resin may be contained in the carrier coating layer 7 in the form of particles. For example, the carrier coating layer 7 may contain the particles of the fluorine-containing resin dispersed in the other resin.

<1-2-2. Carrier Core>

Examples of the carrier core 6 include: particles of iron, iron oxide (for example, ferrite), reduced iron, magnetite, copper, silicon steel, nickel, and cobalt; particles of alloys of these materials and a metal (for example, manganese, magnesium, strontium, zinc, or aluminum); a particle of an iron-nickel alloy; a particle of an iron-cobalt alloy; particles of ceramics; and particles of high-dielectric substances. Examples of the ceramics include titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate. Examples of the high-dielectric substances include ammonium dihydrogen phosphate, potassium dihydrogen phosphate, and Rochelle salt. Among the above, ferrite and alloys containing ferrite are preferable. Only one type of carrier core 6 may be used, or at least two types of carrier cores 6 may be used in combination.

<2. Method for Producing Developer>

The following describes an example of a method for producing the developer 1. In production of the developer 1, the toner particles 2 and the carrier particles 5 are produced. Then, the toner particles 2 and the carrier particles 5 are mixed to obtain the developer 1.

<2-1. Production of Toner Particles>

In production of the toner particles 2, the toner mother particles 3 and the resin particles 4 are produced. Then, the resin particles 4 are caused to adhere to the surface of each of the toner mother particles 3 to obtain the toner particles 2.

(Production of Toner Mother Particles)

Preferable examples of methods for forming the toner mother particles 3 include a pulverization method and an aggregation method. Through these methods, the colorant, the charge control agent, and the releasing agent can be sufficiently dispersed in the binder resin.

In an example of the pulverization method, the binder resin, the colorant, the charge control agent, and the releasing agent are initially mixed. Subsequently, the resultant mixture is melt-kneaded using a melt-kneading device (for example, a single or twin screw extruder). Subsequently, the resultant melt-kneaded product is pulverized and classified. Through the above, the toner mother particles 3 are obtained. The toner mother particles 3 can be produced more easily by the pulverization method than by the aggregation method.

In an example of the aggregation method, the binder resin, the colorant, the charge control agent, and the releasing agent each in the form of particulates are initially caused to aggregate in an aqueous medium to form particles having a desired particle diameter. Through the above, aggregated particles containing components of the binder resin, the colorant, the charge control agent, and the releasing agent are formed. Subsequently, the resultant aggregated particles are heated to cause coalescence of the components contained in the aggregated particles. Through the above, the toner mother particles 3 having a desired particle diameter are obtained. The obtained toner mother particles 3 are washed and dried as necessary. In a situation in which a spray dryer is used in the drying process, the drying process and an external addition process can be carried out simultaneously by spraying a dispersion of an external additive (for example, a number of resin particles 4) toward the toner mother particles 3.

Note that encapsulated toner mother particles 3 may be produced by forming a shell layer on the surface of each toner core corresponding to the toner mother particle 3. The shell layer may be formed by any process. For example, the shell layer may be formed by an in-situ polymerization process, an in-liquid curing film coating process, or a coacervation process.

(Production of Resin Particles)

The resin particles 4 are produced through for example polymerization or copolymerization of the aforementioned monomers for forming the resin particles 4. The following describes, as an example, a situation in which the resin particles 4 are styrene-acrylic acid-based resin particles.

In production of the styrene-acrylic acid-based resin particles, an acrylic acid-based monomer and a styrene-based monomer are caused to react (copolymerize). Through the above, a number of resin particles 4 of a styrene-acrylic acid-based resin are formed. In the copolymerization reaction, the acrylic acid-based monomer and the styrene-based monomer are for example stirred in a solvent while being heated. In the copolymerization reaction, a cross-linking agent, an emulsifier, and a polymerization initiator may be used as necessary in addition to the acrylic acid-based monomer and the styrene-based monomer. In order to cause the copolymerization reaction to proceed favorably, the copolymerization reaction is preferably carried out in a nitrogen atmosphere. Only one type of acrylic acid-based monomer may be used, or at least two types of acrylic acid-based monomers may be used in combination. Also, only one type of styrene-based monomer may be used, or at least two types of styrene-based monomers may be used in combination.

The additive amount of the styrene-based monomer (styrene or styrene derivative) is preferably at least 5 parts by mass and no greater than 50 parts by mass, more preferably at least 10 parts by mass and no greater than 30 parts by mass relative to 100 parts by mass of the acrylic acid-based monomer (acrylic acid or acrylic acid derivative).

A cross-linking agent is preferably used in addition to the acrylic acid-based monomer and the styrene-based monomer. A degree of cross-linking of the styrene-acrylic acid-based resin to be formed can be controlled easily through use of the cross-linking agent. As a result, the degree of aggregation $Y_{160}$ of the resin particles 4 can be easily controlled to a desired value. As the cross-linking agent, a monomer having at least two (preferably two or three, more preferably two) vinyl groups is preferable, and divinylbenzene is more preferable. Only one cross-linking agent may be used, or at least two cross-linking agents may be used in combination. The additive amount of the cross-linking agent is preferably at least 35 parts by mass and no greater than 85 parts by mass relative to 100 parts by mass of the acrylic acid-based monomer (acrylic acid or acrylic acid derivative) since the degree of aggregation $Y_{160}$ of the resin particles 4 can be easily controlled to a desired value in a situation in which the additive amount of the cross-linking agent is within this range.

In a situation in which an emulsifier is used in the copolymerization reaction, examples of the emulsifier include emulsifiers containing salts of sulfonic acids. More specific examples of the emulsifier include sodium dodecylbenzenesulfonate, sodium laurylsulfonate, sodium di(2-ethylhexyl) sulfosuccinate, and sodium isooctylbenzene sulfonate. Sodium dodecylbenzenesulfonate is preferable as the emulsifier since the electrical conductivity of the dispersion of the resin particles 4 can be easily controlled to a desired value in a situation in which sodium dodecylbenzenesulfonate is used as the emulsifier. The additive amount of the emulsifier is preferably at least 4 parts by mass and no greater than 10 parts by mass relative to 100 parts by mass of the acrylic acid-based monomer since the electrical conductivity of the dispersion of the resin particles 4 can be easily controlled to a desired value in a situation in which the additive amount of the emulsifier is within this range.

In a situation in which a polymerization initiator is used in the copolymerization reaction, examples of the polymerization initiator include benzoyl peroxide, t-butyl hydroperoxide, potassium peroxodisulfate, ammonium peroxodisulfate, and hydrogen peroxide. Benzoyl peroxide is preferable as the polymerization initiator. The additive amount of the polymerization initiator is preferably at least 10 parts by mass and no greater than 20 parts by mass relative to 100 parts by mass of the acrylic acid-based monomer.

An example of the solvent used in the copolymerization reaction is an aqueous medium. The aqueous medium refers to a medium containing water as a main component. The aqueous medium may function as the solvent or a dispersion medium. Specific examples of the aqueous medium include water and a mixed liquid of water and a polar solvent. Examples of the polar solvent contained in the aqueous medium include methanol and ethanol. The water content in the aqueous medium is preferably at least 80% by mass, further preferably at least 90% by mass, and most preferably 100% by mass relative to the mass of the aqueous medium. Water is preferably used as the solvent in order to cause the copolymerization reaction to proceed favorably. The additive amount of the solvent is preferably at least 200 parts by mass and no greater than 1000 parts by mass, and more preferably at least 500 parts by mass and no greater than 700 parts by mass relative to 100 parts by mass of the acrylic acid-based monomer in order to cause the copolymerization reaction to proceed favorably.

The number average primary particle diameter of the resin particles 4 to be formed can be controlled by changing one or both of a reaction time and stirring conditions of the copolymerization reaction. The number average primary particle diameter of the resin particles 4 to be formed tends to increase as the reaction time of the copolymerization reaction increases. The number average primary particle diameter of the resin particles 4 to be formed tends to increase as a stirring rate in the copolymerization reaction decreases.

The reaction temperature of the copolymerization reaction is preferably at least 70° C. and no greater than 100° C., and more preferably at least 85° C. and no greater than 95° C. in order to cause the copolymerization reaction to proceed favorably. For the same reason, the reaction time of the polymerization reaction is preferably at least one hour and no greater than five hours.

(External Addition)

The toner mother particles 3 and the resin particles 4 are mixed using a mixer (for example, FM mixer manufactured by Nippon Coke & Engineering Co., Ltd.). Mixing conditions are preferably set such that the resin particles 4 do not completely embedded in the toner mother particles 3. Through the mixing, a plurality of the resin particles 4 are caused to adhere to the surface of each of the toner mother particles 3. As a result, the toner particles 2 are obtained.

<2-2. Production of Carrier Particles>

In production of the carrier particles 5, carrier cores 6 are each covered by the carrier coating layer 7. Initially, the carrier cores 6 are prepared. Subsequently, a liquid for forming the carrier coating layer 7 (hereinafter may be referred to as a carrier-coating-layer formation liquid) is prepared. Specifically, a fluorine-containing resin is dispersed in an aqueous medium. Another resin may be added to the carrier-coating-layer formation liquid. A surfactant (preferably nonionic surfactant) may be added to the carrier-coating-layer formation liquid in order to sufficiently disperse the fluorine-containing resin. Subsequently, the carrier-coating-layer formation liquid is sprayed toward the carrier cores using a fluidized bed coating apparatus. As a result, the carrier cores are each covered by an uncured organic layer (fluidized bed). The carrier cores each covered by the uncured organic layer (fluidized bed) are heated using a drier. Through the above, the fluidized bed is cured. As a result, the carrier particles 5 each including the carrier core 6 and the carrier coating layer 7 covering the carrier core 6 are obtained.

<2-3. Mixing of Toner and Carrier>

The toner (a number of toner particles 2) and the carrier (a number of carrier particles 5) are mixed using a mixer (for example, Rocking Mixer (registered Japanese trademark) or a ball mill). As a result, the developer 1 is obtained.

In production of the developer 1, an unnecessary process may be omitted. For example, in a situation in which a commercially available product can be used directly as a material, the use of the commercially available product can eliminate the need to prepare the material. In order to efficiently produce the developer 1, it is preferable to simultaneously form a number of particles (toner particles 2 or carrier particles 5).

<3. Image Forming Apparatus and Image Forming Method>

Figure 2:
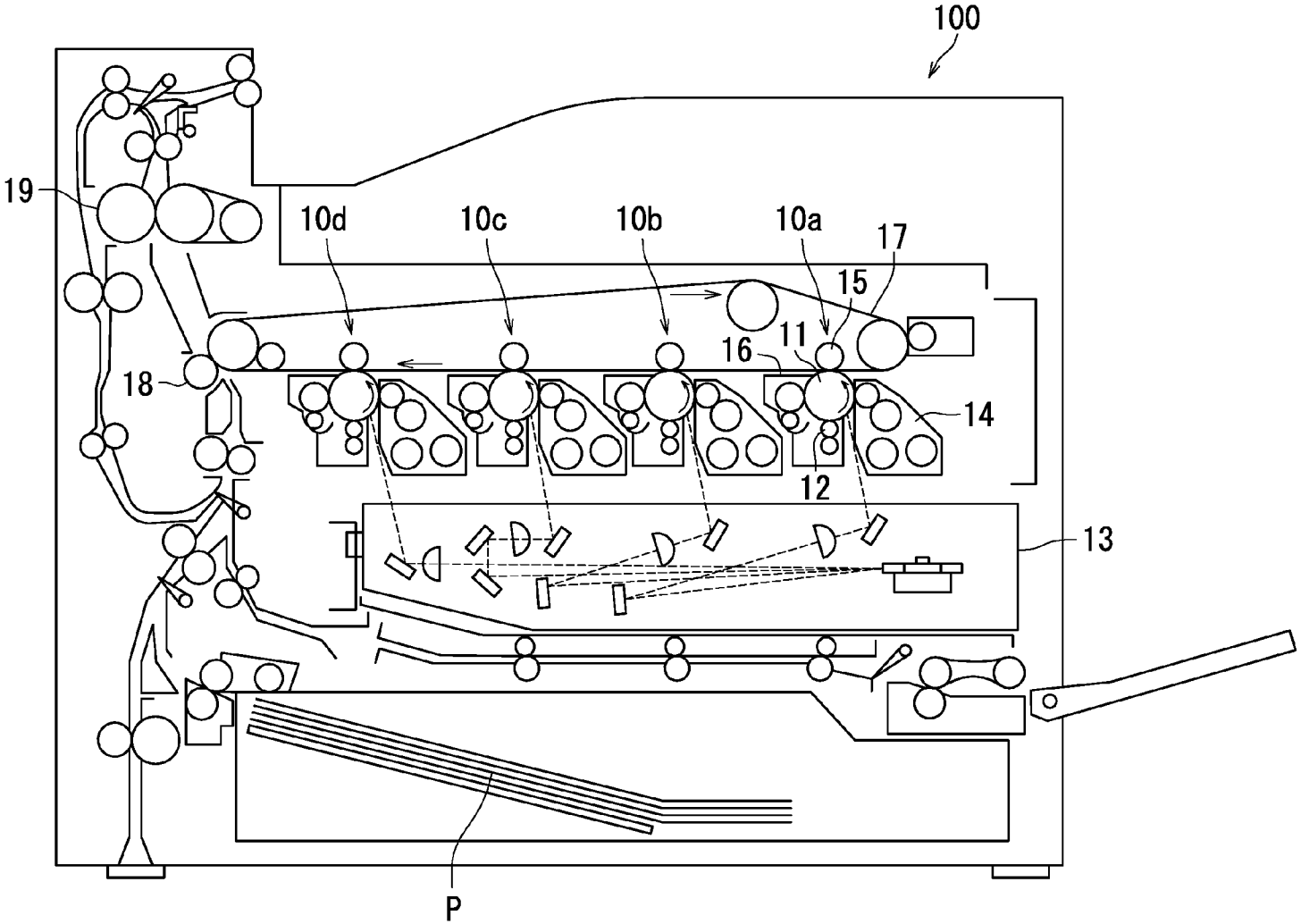
FIG. 2 is a diagram illustrating an example of a configuration of an image forming apparatus in which the developer according to the embodiment of the present disclosure is used.

The following describes the image forming apparatus 100 and an image forming method in which the developer 1 according to the present embodiment is used, with reference to FIG. 2. FIG. 2 illustrates an example of a configuration of the image forming apparatus 100. The image forming apparatus 100 includes for example the image bearing member 11 and the development section 14. The developer 1 according to the present embodiment is used in the image forming apparatus 100. The developer 1 is stored in the development section 14. The image forming apparatus 100 may further include a charger 12, an exposure section 13, a transfer section (a primary transfer section 15 only, or the primary transfer section 15 and a secondary transfer section 18), the cleaning section 16, a transfer belt 17, and a fixing section 19.

The image forming method using the image forming apparatus 100 includes a developing step. The image forming method may further include at least one of a charging step, an exposing step (electrostatic latent image forming step), a transferring step, and a fixing step.

In the charging step, the charger 12 charges the surface of the image bearing member 11. Examples of the charger 12 include non-contact type chargers (for example, a corotron charger and a scorotron charger) and contact type chargers (for example, a charging roller and a charging brush). The charging polarity of the charger 12 is not particularly limited. For example, the charger 12 may positively charge the surface of the image bearing member 11, and the development section 14 may supply a positively charged toner to the surface of the photosensitive member 11 to develop an electrostatic latent image into a toner image.

In the exposing step (electrostatic latent image forming step), the exposure section 13 exposes the charged surface of the image bearing member 11 to light. Through the above, an electrostatic latent image is formed on the surface of the image bearing member 11.

In the developing step, the development section 14 supplies the toner (a number of toner particles 2) included in the developer 1 to the electrostatic latent image formed on the surface of the image bearing member 11. Through the above, the electrostatic latent image is developed into a toner image. The image bearing member 11 bears the toner image. The development section 14 and the image bearing member 11 will be described further below.

In the transferring step, the transfer section transfers the toner image including the toner from the image bearing member 11 to a recording medium P. In the transferring step, for example, an intermediate transfer process or a direct transfer process may be employed. In the intermediate transfer process, the primary transfer section 15 performs primary transfer of the toner image from the image bearing member 11 to the transfer belt 17. Subsequently, the secondary transfer section 18 performs secondary transfer of the toner image from the transfer belt 17 to the recording medium P. In the direct transfer process, the primary transfer section 15 transfers the toner image from the image bearing member 11 to the recording medium P conveyed by the transfer belt 17. In the direct transfer process, the image bearing member 11 is in contact with the recording medium P at the time of transfer of the toner image to the recording medium P. The secondary transfer section 18 is omitted in the image forming apparatus 100 employing the direct transfer process. A toner remaining on the surface of the image bearing member 11 after the transfer is cleaned by the cleaning section 16 as necessary.

In the fixing step, the fixing section 19 fixes the unfixed toner image, which has been transferred to the recording medium P, by applying heat and/or pressure. Through the above, an image is formed on the recording medium P.

Note that the image forming apparatus 100 is not particularly limited as long as it is an electrophotographic image forming apparatus. The image forming apparatus 100 may for example be a monochrome image forming apparatus or a color image forming apparatus. In order to form toner images in respective colors different from each other, the image forming apparatus 100 may be a tandem color image forming apparatus. In a situation in which the image forming apparatus 100 is a monochrome image forming apparatus, the image forming apparatus 100 includes for example an image forming unit 10*a*. The image forming unit 10*a* includes the image bearing member 11, the charger 12, the development section 14, the primary transfer section 15, and the cleaning section 16. The image bearing member 11 is located at a central position of the image forming unit 10*a*. The image bearing member 11 is rotatable in the arrowed direction (counterclockwise). Around the image bearing member 11, the charger 12, the development section 14, the primary transfer section 15, and the cleaning section 16 are arranged in stated order from upstream to downstream in the rotation direction of the image bearing member 11. In a situation in which the image forming apparatus 100 is a tandem color image forming apparatus, the image forming apparatus 100 includes for example image forming units 10*a*, 10*b*, 10*c*, and 10*d*. The image forming units 10*b*, 10*c*, and 10*d* have the same configuration as the image forming unit 10*a*.

(Image Bearing Member)

Figure 3A:
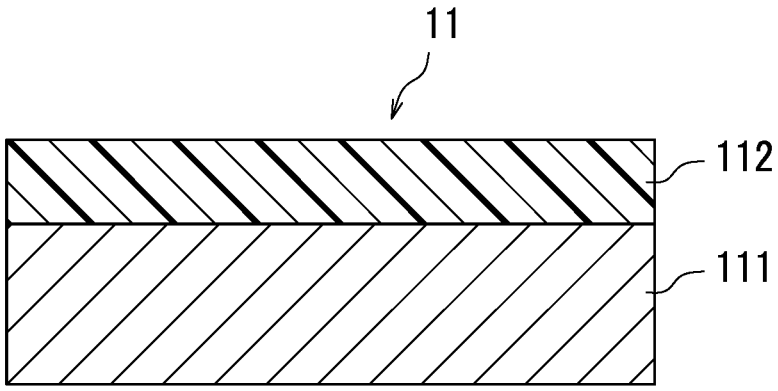
FIGS. 3A and 3B are partial cross-sectional views each illustrating an image bearing member included in the image forming apparatus illustrated in FIG. 2.
Figure 3B:
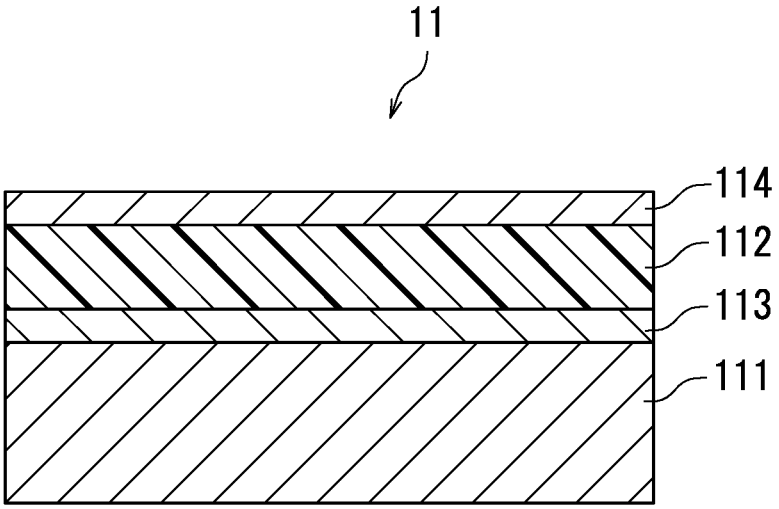

Next, the following describes the image bearing member 11 in more detail with reference to FIGS. 3A and 3B. FIGS. 3A and 3B each illustrate a partial cross-sectional view of the image bearing member 11. As illustrated in FIG. 3A, the image bearing member 11 includes a conductive substrate 111 and a photosensitive layer 112 (corresponding to photoconductive layer). An electrostatic latent image is formed on the photosensitive layer 112 of the image bearing member 11.

As illustrated in FIG. 3B, the image bearing member 11 may include an undercoat layer (corresponding to charge injection inhibition layer) 113 or a protective layer 114 as necessary. The undercoat layer 113 is provided for example between the conductive substrate 111 and the photosensitive layer 112. The protective layer 114 is provided for example as the topmost layer on the photosensitive layer 112.

The image bearing member 11 is an amorphous silicon photosensitive member. The amorphous silicon photosensitive member has higher abrasion resistance and higher durability than an organic photosensitive member. However, insulation breakdown in the photosensitive layer 112 is caused more easily in the amorphous silicon photosensitive member than in the organic photosensitive member. In this respect, the developer 1 of the present embodiment can inhibit occurrence of the insulation breakdown in the photosensitive layer 112 as described above. Therefore, even in a configuration in which the image forming apparatus 100 in which the developer 1 of the present embodiment is used includes the amorphous silicon photosensitive member as the image bearing member 11, occurrence of the insulation breakdown in the photosensitive layer 112 can be inhibited to prevent generation of black spots in a formed image.

At least a surface portion of the conductive substrate 111 contains a conductive material. For example, the entirety of the conductive substrate 111 may be formed from the conductive material. Alternatively, an insulating material (for example, a resin or glass) covered by the conductive material may be used as the conductive substrate 111. Examples of the conductive material contained in the conductive substrate 111 include aluminum (Al), zinc (Zn), copper (Cu), iron (Fe), titanium (Ti), nickel (Ni), chromium (Cr), tantalum (Ta), tin (Sn), gold (Au), and silver (Ag). Only one conductive material may be used, or at least two conductive materials may be used in combination (for example as an alloy). Examples of alloys of the conductive materials include stainless steel (SUS). Among the above conductive materials, aluminum and an aluminum alloy are preferable in terms of excellent adhesion to the photosensitive layer 112 and excellent charge mobility from the photosensitive layer 112 to the conductive substrate 111. The conductive substrate 111 has a cylindrical shape for example.

The photosensitive layer 112 of the image bearing member 11 contains an amorphous (non-crystalline) silicon-based material. Examples of the amorphous silicon-based material include amorphous silicon containing carbon atoms (a-SiC), amorphous silicon containing carbon atoms and nitrogen atoms (a-SiCN), amorphous silicon containing nitrogen atoms and oxygen atoms (a-SiNO), amorphous silicon containing carbon atoms and oxygen atoms, (a-SiCO), amorphous silicon containing nitrogen atoms (a-SiN), amorphous silicon (a-Si), and amorphous silicon containing oxygen atoms (a-SiO). Further, it is preferable that the amorphous silicon-based material further contains at least one atom selected from the group consisting of a hydrogen atom and halogen atoms since charge mobility in the photosensitive layer 112 can be easily controlled in such a configuration.

The thickness of the photosensitive layer 112 is for example preferably at least 1 μm and no greater than 100 μm in order to improve electric characteristics of the image bearing member 11.

(Development Section)

Figure 4:
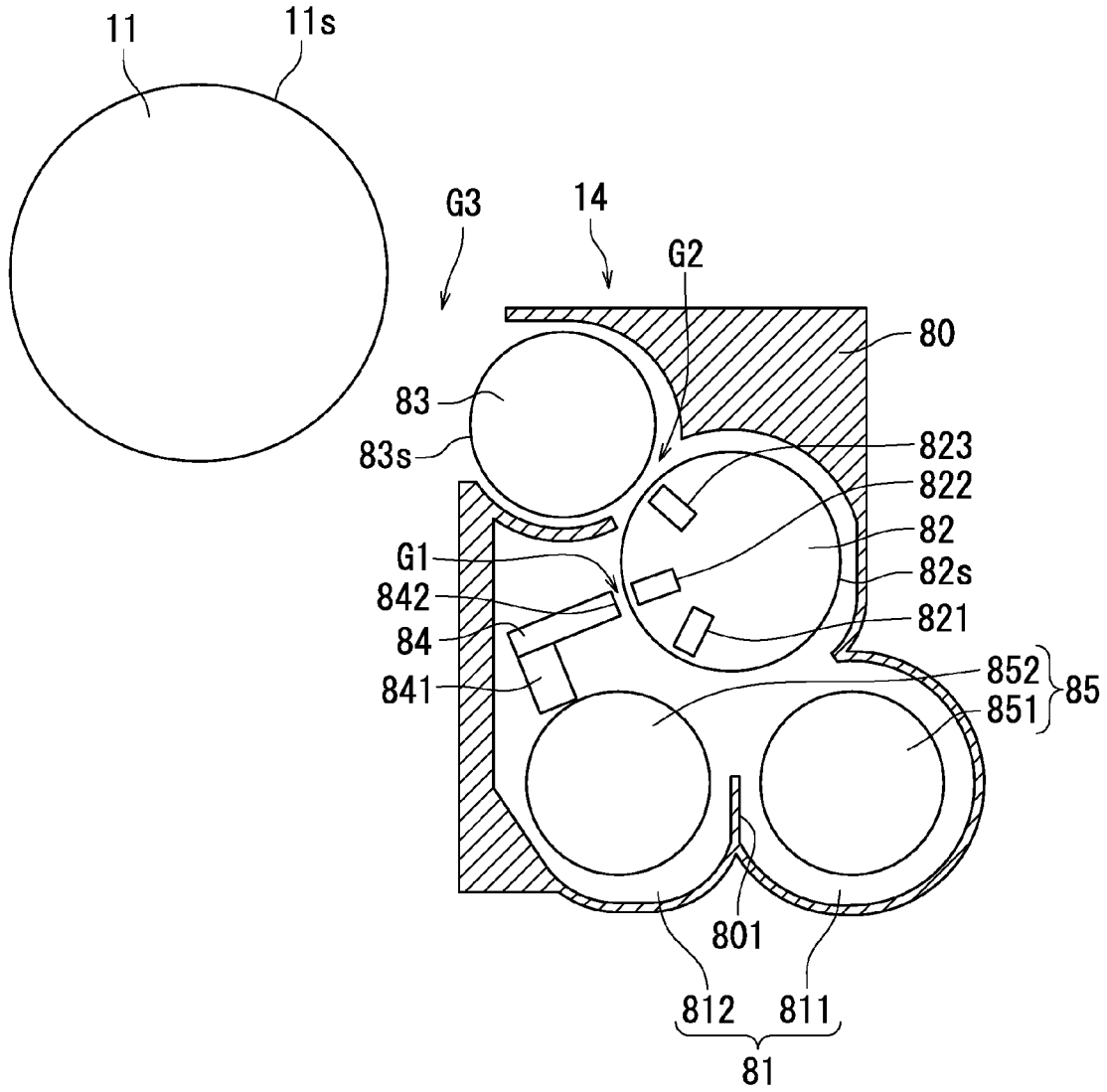
FIG. 4 is a diagram illustrating a development section and the image bearing member included in the image forming apparatus illustrated in FIG. 2.

Next, the following describes an example of the development section 14 employing a touchdown developing method with reference to FIG. 4. The development section 14 performs development operation. The development section 14 can further perform refresh operation. The development operation corresponds to the developing step in the image forming method. The refresh operation corresponds to a toner ejection step in the image forming method.

(Development Operation)

The development operation refers to developing, by the development section 14, an electrostatic latent image into a toner image by supplying the toner (a number of toner particles 2) included in the developer 1 to an electrostatic latent image formed on the circumferential surface (surface) 11*s* of the image bearing member 11.

FIG. 4 illustrates the development section 14 and the image bearing member 11 included in the image forming apparatus 100. The development section 14 includes a housing 80, a developer conveyance path 81, a developer bearing member 82, a toner bearing member 83, a developer limiting member 84, and a developer stirring conveyance member 85. The developer bearing member 82, the toner bearing member 83, and the developer limiting member 84 respectively correspond to a magnetic roller, a development roller, and a developer limiting blade. The developer conveyance path 81, the developer bearing member 82, the toner bearing member 83, the developer limiting member 84, and the developer stirring conveyance member 85 are located within the housing 80. The developer 1 is accommodated in the developer conveyance path 81.

The housing 80 includes a partition wall 801. The developer conveyance path 81 includes a first conveyance path 811 and a second conveyance path 812. The first conveyance path 811 and the second conveyance path 812 extend substantially parallel to each other. The partition wall 801 is located between the first conveyance path 811 and the second conveyance path 812.

The developer stirring conveyance member 85 includes a first conveyance screw 851 and a second conveyance screw 852. The first conveyance screw 851 is located in the first conveyance path 811. The second conveyance screw 852 is located in the second conveyance path 812. The first conveyance screw 851 and the second conveyance screw 852 are substantially parallel to each other.

The first conveyance screw 851 rotates to convey the developer 1 within the first conveyance path 811 while stirring the developer 1. The second conveyance screw 852 rotates to convey the developer 1 within the second conveyance path 812 while stirring the developer 1. As a result, the developer 1 is conveyed while circulating through the first conveyance path 811 and the second conveyance path 812.

The developer bearing member 82 is located opposite to the developer stirring conveyance member 85 and rotatably supported by the housing 80. A cylindrical magnet (not shown) is non-rotatably fixed inside the developer bearing member 82. The magnet includes a plurality of magnetic poles. The magnet includes for example a pump pole 821, a limiting pole 822, and a main pole 823. The pump pole 821 is located opposite to the developer stirring conveyance member 85. The limiting pole 822 is located opposite to the developer limiting member 84. The main pole 823 is located opposite to the toner bearing member 83.

The developer bearing member 82 magnetically pumps up (attracts) the developer 1 from the developer conveyance path 81 onto the circumferential surface 82*s* of the developer bearing member 82 by magnetic force of the pump pole 821. The pumped-up developer 1 is magnetically retained on the circumferential surface 82*s* of the developer bearing member 82 as a layer of the developer 1 (magnetic brush layer). The retained developer 1 is conveyed to the developer limiting member 84 as the developer bearing member 82 rotates.

The developer limiting member 84 is located downstream of the developer stirring conveyance member 85 in a rotation direction of the developer bearing member 82. The developer limiting member 84 limits the thickness of the layer of the developer 1 magnetically adhering to the circumferential surface 82*s* of the developer bearing member 82. The developer limiting member 84 extends in a longitudinal direction of the developer bearing member 82. The developer limiting member 84 is for example a plate member formed from a magnetic material. The developer limiting member 84 is supported by a support member 841 fixed to the housing 80. The developer limiting member 84 has a limiting surface 842. The limiting surface 842 corresponds to the end face of the developer limiting member 84. A first gap (so-called limiting gap) G1 is provided between the limiting surface 842 and the circumferential surface 82*s* of the developer bearing member 82.

The developer limiting member 84 is magnetized by the limiting pole 822 of the developer bearing member 82. As a result, a magnetic path is formed in the first gap G1 between the limiting surface 842 of the developer limiting member 84 and the limiting pole 822. The layer of the developer 1 that has been caused to adhere to the circumferential surface 82*s* of the developer bearing member 82 by the pump pole 821 is conveyed to the first gap G1 as the developer bearing member 82 rotates. Subsequently, the thickness of the layer of the developer 1 is limited at the first gap G1. Through the above, the layer of the developer 1 with a specific thickness is formed on the circumferential surface 82*s* of the developer bearing member 82.

The toner bearing member 83 is located downstream of the developer limiting member 84 in the rotation direction of the developer bearing member 82. The toner bearing member 83 is located opposite to the developer bearing member 82 and rotatably supported by the housing 80. A second gap G2 is provided between the circumferential surface 83*s* of the toner bearing member 83 and the circumferential surface 82*s* of the developer bearing member 82.

The toner bearing member 83 rotates while being in contact with the layer of the developer 1 formed on the circumferential surface 82*s* of the developer bearing member 82. At the second gap G2, specific bias is applied to each of the toner bearing member 83 and the developer bearing member 82. An absolute value $V_{83}$ of the bias applied to the toner bearing member 83 is smaller than an absolute value $V_{82}$ of the bias applied to the developer bearing member 82. As a result, a specific potential difference is generated between the circumferential surface 83*s* of the toner bearing member 83 and the circumferential surface 82*s* of the developer bearing member 82. The charging polarity of the toner is for example the same as the polarity of the bias applied to the toner bearing member 83 and the developer bearing member 82. Therefore, the generated potential difference causes the toner (a number of toner particles 2) to move from the layer of the developer 1 on the circumferential surface 82*s* of the developer bearing member 82 to the circumferential surface 83*s* of the toner bearing member 83. The carrier (a number of carrier particles 5) contained in the layer of the developer 1 remains on the circumferential surface 82*s* of the developer bearing member 82. As a result, a layer of the toner (a number of toner particles 2) is formed on the circumferential surface 83*s* of the toner bearing member 83.

The toner bearing member 83 is located opposite to the image bearing member 11 with an opening of the housing 80 therebetween. A third gap G3 is provided between the circumferential surface 83*s* of the toner bearing member 83 and the circumferential surface of the image bearing member 11.

The layer of the toner (a number of toner particles 2) formed on the circumferential surface 83*s* of the toner bearing member 83 is conveyed toward the circumferential surface 11*s* of the image bearing member 11 as the toner bearing member 83 rotates. At the third gap G3, specific bias is applied to the toner bearing member 83. An absolute value $V_{83}$ of the bias applied to the toner bearing member 83 is larger than an absolute value $V_{11E}$ of the surface potential of an exposed region of the image bearing member 11. The absolute value $V_{83}$ of the bias applied to the toner bearing member 83 is smaller than an absolute value $V_{11UE}$ of the surface potential of an unexposed region of the image bearing member 11. As a result, a specific potential difference is generated between the circumferential surface 11*s* of the image bearing member 11 and the circumferential surface 83*a* of the toner bearing member 83. The charging polarity of the toner is for example the same as the polarity of the bias applied to the toner bearing member 83 and the charging polarity of the image bearing member 11. Therefore, the generated potential difference causes the toner (a number of toner particles 2) to move from the layer of the toner on the circumferential surface 83*s* of the toner bearing member 83 to the exposed region of the circumferential surface 11*s* of the image bearing member 11. Through the above, an electrostatic latent image (corresponding to the exposed region) on the circumferential surface 11*s* of the image bearing member 11 is developed into a toner image.

(Refresh Operation)

The development section 14 can further perform the refresh operation in addition to the development operation. The refresh operation refers to ejecting, by the development section 14, the toner to the image bearing member 11 while not performing development (for example, during a non-image formation time). The refresh operation is performed for example in a situation in which a coverage rate of a recording medium P is lower than a threshold value. The refresh operation is performed for example during a period between printing on sheets of the recording medium P or during a period between print jobs. The period between printing on sheets of the recording medium P is a period between completion of the development operation for forming an image on a sheet of the recording medium P and initiation of the development operation for forming an image on another sheet of the recording medium P in a situation in which images are successively formed on a plurality of sheets of the recording medium P. The period between print jobs is a period between completion of a series of print jobs for successively forming images on a plurality of sheets of the recording medium P and initiation of another series of print jobs.

In the refresh operation, for example an electrostatic latent image corresponding to a solid image is formed on the image bearing member 11. That is, the entire circumferential surface 11*s* of the image bearing member 11 is exposed to light. Then, the development section 14 supplies the toner (a number of toner particles 2) included in the developer 1 to the electrostatic latent image corresponding to the solid image formed on the circumferential surface (surface) 11*s* of the image bearing member 11. The operation of supplying, by the development section 14, the toner to the electrostatic latent image on the circumferential surface 11*s* of the image bearing member 11 is the same as the development operation described above. Note that the toner ejected onto the image bearing member 11 by the refresh operation is not transferred by the transfer section to the recording medium P.

The refresh operation has the following advantage. In a situation in which images with low coverage rates are successively formed, an amount of the toner supplied from the toner bearing member 83 to the image bearing member 11 decreases. Therefore, the toner tends to stay in the development section 14 for a long period of time. As a result, the toner in the development section 14 may be deteriorated, resulting in low image density and fogging of a formed image. The refresh operation can prevent the toner from staying in the development section 14 for a long period of time. As a result, low image density and fogging of a formed image can be prevented.

However, insulation breakdown in the photosensitive layer 112 of the image bearing member 11 tends to be caused in the image forming apparatus 100 including the development section 14 that performs the refresh operation. This is because a large amount of toner is ejected onto the image bearing member 11 by the refresh operation and the toner tends to accumulate in a region of contact between the image bearing member 11 and the end of the cleaning section 16. However, the developer 1 of the present embodiment can inhibit occurrence of the insulation breakdown in the photosensitive layer 112 to prevent generation of black spots in a formed image as described above. Therefore, even in a configuration in which the image forming apparatus 100 includes the development section 14 that performs the refresh operation, generation of black spots in a formed image can be prevented through use of the developer 1 of the present embodiment.

Through the above, an example of the development section 14 employing the touchdown developing method has been described with reference to FIG. 4. However, the developing method of the development section 14 is not particularly limited, and may be a two-component developing method or any other developing method. In a situation in which the development section 14 employs the two-component developing method, the development section 14 has the same configuration as the configuration described above with respect to the touchdown developing method, except that the development section 14 does not include the toner bearing member 83. In the two-component developing method, specific bias is applied to the developer bearing member 82. As a result, a potential difference is generated between the circumferential surface 11*s* of the image bearing member 11 and the circumferential surface 82*s* of the developer bearing member 82. The generated potential difference causes the toner (a number of toner particles 2) to move from the layer of the developer 1 on the circumferential surface 82*s* of the developer bearing member 82 to the circumferential surface 11*s* of the image bearing member 11. The carrier (a number of carrier particles 5) remains on the circumferential surface 82*s* of the developer bearing member 82. As a result, an electrostatic latent image formed on the circumferential surface 11*s* of the image bearing member 11 is developed into a toner image.

Through the above, the developer of the present embodiment, and the image forming apparatus and the image forming method in which the developer of the present embodiment is used have been described. According to the developer of the present embodiment, and the image forming apparatus and the image forming method in which the developer of the present embodiment is used, generation of black spots (particularly leak black spots) can be prevented, image density and fogging resistance can be improved, and adhesion of external additive particles to the image bearing member can be inhibited.

Examples

The following describes examples of the present disclosure. However, the present disclosure is by no means limited to the following examples.

<1. Production of Resin Particles>

As resin particles for forming toner particles, resin particles A to M were produced by the following method.

(Production of Resin Particle R-A)

A 1000-mL four-necked flask equipped with a stirrer, a cooling tube, a thermometer, and a nitrogen inlet tube was prepared. Then, 100 g of butyl methacrylate (BMA), 20 g of styrene, 70 g of divinylbenzene (DVB) as a cross-linking agent, 6 g of sodium dodecylbenzenesulfonate (DBS) as an emulsifier, 15 g of benzoyl peroxide (BPO) as a polymerization initiator, and 600 g of ion exchanged water were put into the flask while being stirred. The flask contents were caused to react (copolymerize) under stirring for three hours at a temperature of 90° C. while nitrogen gas was introduced into the flask. As a result, emulsion of a reaction product (resin particles R-A) was obtained. The emulsion of the resin particles R-A was cooled, washed, and dehydrated. Through the above, copolymer particles (resin particles R-A) were separated from the emulsion. The number average primary particle diameter of the resin particles R-A was 90 nm.

(Production of Resin Particles R-B to R-M)

Resin particles R-B to R-M were produced by the same method as the resin particles R-A other than the changes described below. The additive amount of sodium dodecylbenzenesulfonate (DBS), which was 6 g in the production of the resin particles R-A, was changed to additive amounts shown in Table 1. The additive amount of divinylbenzene (DVB), which was 70 g in the production of the resin particles R-A, was changed to additive amounts shown in Table 1. The number average primary particle diameter of the resin particles, which was 90 nm for the resin particles R-A, was changed to number average primary particle diameters shown in Table 1 by changing the reaction time of the flask contents, which was three hours in the production of the resin particles R-A. Note that the number average primary particle diameter of the resin particles increases as the reaction time of the flask contents increases.

(Measurement of Number Average Primary Particle Diameter)

The number average primary particle diameter of each of the resin particles R-A to R-M was measured by the following method. A measurement sample (resin particles) was observed at a magnification of ×100,000 using a field emission scanning electron microscope (FE-SEM, "JSM-3000" manufactured by JEOL Ltd.). Among resin particles observed within the field of view of the microscope, 10 resin particles were selected arbitrarily. The primary particle diameter (the diameter of a circle having the same area as a projected area of the resin particle, that is, the equivalent circle diameter) was measured for each of the selected 10 resin particles. The sum of the primary particle diameters of the 10 resin particles was divided by the number of the measured resin particles (10). Through the above, the number average primary particle diameter of the resin particles was calculated.

(Measurement of Degree of Aggregation $Y_{160}$)

The degree of aggregation $Y_{160}$ of each of the resin particles R-A to R-M was measured by the following method. The degree of aggregation $Y_{160}$ was measured in an environment at a temperature of 23° C. and a relative humidity of 50%. A jig that includes a base with a cylindrical hole (diameter: 10 mm, depth: 10 mm, material: SUS304) formed therein, an indenter (diameter: 10 mm, material: SUS304), and a heater was used for the measurement of the degree of aggregation $Y_{160}$. Note that SUS304 refers to austenitic stainless steel (an alloy of iron (Fe), chromium (Cr), and nickel (Ni) having a nickel content of 8% and a chromium content of 18%).

First, 10 mg of a measurement sample (any of the resin particles R-A to R-M) was put into the cylindrical hole of the jig. A pressure of 0.1 kgf/mm$^2$ (100N) was applied to the 10 mg of the measurement sample using the indenter for five minutes while the measurement sample was heated to 160° C. After the pressure application, the whole measurement sample was collected. The mass of the collected measurement sample (mass of the measurement sample before being separated using a sieve) $M_{160B}$ was measured.

Thereafter, the collected measurement sample was set on a sieve having openings of 75 μm (a plain-woven sieve of 200 mesh specified in JIS Z8801-1 and having a wire diameter of 50 μm and square openings). The measurement sample was sucked from underneath the sieve using a suction machine ("V-3SDR" manufactured by Amano Corporation) to separate the measurement sample. The mass $M_{160A}$ of the measurement sample remained on the sieve after the separation was measured.

The degree of aggregation $Y_{160}$ of the measurement sample at a temperature of 160° C. was calculated according to expression (1) shown below from the mass ($M_{160B}$) of the measurement sample before being separated using the sieve and the mass ($M_{160A}$) of the measurement sample remained on the sieve after the separation.

$$Y_{160}(\%\text{ by mass})=100\times M_{160A}/M_{160B} \quad (1)$$

(Measurement of Electrical Conductivity)

The electrical conductivity of a dispersion of each of the resin particles R-A to R-M was measured by the following method. A beaker was charged with 100 mL of distilled water and 0.1 g of a measurement sample (any of the resin particles R-A to R-M). The beaker contents were dispersed for two minutes using an ultrasonic cleaner ("US-18KS" manufactured by SND Co., Ltd., tank volume: 18 L, high-frequency output: 360 W, oscillating method: self-excited oscillation by BLT (Langevin type oscillator fastened by bolt), oscillatory frequency: 38 kHz) to obtain a dispersion. The electrical conductivity of the dispersion was measured using an electrical conductivity meter (portable electrical conductivity meter "ES-71" manufactured by Horiba, Ltd.).

Table 1 shows measured values of the number average primary particle diameter, the degree of aggregation $Y_{160}$, and the electrical conductivity of the resin particles R-A to R-M. In Table 1, BMA, DBS, BPO, DVB, and $Y_{160}$ respectively represent butyl methacrylate, sodium dodecylbenzenesulfonate (emulsifier), benzoyl peroxide (polymerization initiator), divinylbenzene (cross-linking agent), and the degree of aggregation of the resin particles at a temperature of 160° C. Measurement targets of the number average primary particle diameter shown in Table 1 were resin particles. Measurement targets of the electrical conductivity shown in Table 1 were dispersions each obtained by dispersing 0.1 g of resin particles in 100 mL of distilled water.

TABLE 1

| Resin particle | Additive amounts of raw materials DBS (g) | BMA (g) | styrene (g) | BPO (g) | DVB (g) | Number average primary particle diameter (nm) | $Y_{160}$ (wt %) | Electrical conductivity (μS/m) |
|---|---|---|---|---|---|---|---|---|
| R-A | 6 | 100 | 20 | 15 | 70 | 90 | 20 | 3.0 |
| R-B | 6 | 100 | 20 | 15 | 85 | 90 | 15 | 3.0 |
| R-C | 6 | 100 | 20 | 15 | 35 | 90 | 40 | 3.0 |
| R-D | 4 | 100 | 20 | 15 | 70 | 90 | 20 | 2.5 |
| R-E | 10 | 100 | 20 | 15 | 70 | 90 | 20 | 6.0 |
| R-F | 6 | 100 | 20 | 15 | 70 | 70 | 20 | 3.0 |
| R-G | 6 | 100 | 20 | 15 | 70 | 200 | 20 | 3.0 |
| R-H | 6 | 100 | 20 | 15 | 20 | 90 | 45 | 3.0 |
| R-I | 6 | 100 | 20 | 15 | 100 | 90 | 12 | 3.0 |
| R-J | 3 | 100 | 20 | 15 | 70 | 90 | 20 | 2.0 |
| R-K | 12 | 100 | 20 | 15 | 70 | 90 | 20 | 6.5 |
| R-L | 6 | 100 | 20 | 15 | 70 | 60 | 20 | 3.0 |
| R-M | 6 | 100 | 20 | 15 | 70 | 220 | 20 | 3.0 |

<2. Production of Developer A-1>

(Production of Toner Mother Particles)

Initially, toner mother particles for producing toner particles were produced. A binder resin, a colorant, a charge control agent, and a releasing agent indicated below were used as raw materials of the toner mother particles.

Binder resin: polyester resin (acid value: 5.6, melting point: 105° C.)

Colorant: copper phthalocyanine pigment (C.I. Pigment Blue 15:3)

Charge control agent: quaternary ammonium salt ("BONTRON (registered Japanese trademark) P-51" manufactured by Orient Chemical Industries, Co., Ltd.)

Releasing agent: ester wax ("NISSAN ELECTOL (registered Japanese trademark) WEP-3" manufactured by NOF Corporation, fusing temperature: 73° C.)

A mixture was obtained by stirring 100 parts by mass of the binder resin, 5 parts by mass of the releasing agent, 4 parts by mass of the colorant, and 1 part by mass of the charge control agent, using a FM mixer ("FM-10B" manufactured by Nippon Coke & Engineering Co., Ltd.). The mixture was kneaded using a twin screw extruder ("PCM-30" manufactured by Ikegai Corp.) while being melted. The resultant melt-kneaded product was pulverized using a pulverizer ("Turbo Mill Type RS" manufactured by FREUND-TURBO CORPORATION). The resultant pulverized product was classified using a classifier ("Elbow-Jet EJ-LABO" manufactured by Nittetsu Mining Co., Ltd.). Through the above, the toner mother particles were obtained. The volume median diameter $D_{50}$ of the obtained toner mother particles was 6.8 μm.

(Production of Toner)

First, 100 parts by mass of the toner mother particles and 1 part by mass of hydrophobic silica particles ("AEROSIL (registered Japanese trademark) RA-200H" manufactured by Nippon Aerosil Co., Ltd.) were mixed for five minutes at a rotation speed of 3500 rpm using a FM mixer ("FM-10B" manufactured by Nippon Coke & Engineering Co., Ltd.). Then, 1 part by mass of the resin particles R-A as external additive particles were added to the mixture, and mixing was further performed for five minutes at the rotation speed of 3500 rpm using the FM mixer ("FM-10B" manufactured by Nippon Coke & Engineering Co., Ltd.). As a result, a toner for a developer A-1 was obtained.

(Production of Carrier C-A)

Uncoated ferrite cores ("EF-35B" manufactured by Powdertech Co., Ltd., the number average primary particle diameter: 35 μm) were used as carrier cores. A carrier-coating-layer formation liquid A was prepared. Specifically, a polyamide-imide resin (copolymer of trimellitic anhydride and 4,4'-diaminodiphenylmethane) was diluted with water to prepare a resin solution. Tetrafluoroethylene-perfluoroalkylvinylether copolymer (PFA, perfluorooctanoic acid content: 3 ppm) and polyoxyethylene alkyl ether as a nonionic surfactant were added to the resin solution and dispersed therein. As a result, the carrier-coating-layer formation liquid A was obtained. The carrier-coating-layer formation liquid A had a solid concentration of 10% by mass. A mass ratio between the polyamide-imide resin and PFA in the carrier-coating-layer formation liquid A was 2/8.

Then, 50 parts by mass of the carrier-coating-layer formation liquid A was sprayed toward 1000 parts by mass of the carrier cores using a fluidized bed coating apparatus ("SPIR-A-FLOW (registered Japanese trademark) SFC-5" manufactured by Freund Corporation) while supplying hot air at a temperature of 100° C. As a result, the carrier cores were each covered by an uncured organic layer (fluidized bed). The carrier cores each covered by the uncured organic layer (fluidized bed) were heated for one hour at a temperature of 220° C. using a drier. Through the above, the fluidized bed was cured. As a result, a carrier C-A including the carrier cores each covered by a carrier coating layer (resin layer containing a fluorine-containing resin) was obtained.

(Mixing of Toner and Carrier)

Using a powder mixer ("Rocking Mixer (registered Japanese trademark)" manufactured by Aichi Electric Co., Ltd., mixing method: container rotating and rocking method), 9 parts by mass of the toner for the developer A-1 and 100 parts by mass of the carrier C-A were mixed for 30 minutes. As a result, the developer A-1 was obtained.

<3. Production of Developers A-2 to A-7 and B-1 to B-6>

Developers A-2 to A-7 and B-1 to B-6 were each produced by the same method as the developer A-1 other than the changes described below. The external additive particles used in the production of the toner, which were the resin particles R-A in the production of the developer A-1, were changed to external additive particles shown in Table 2 (any of the resin particles R-B to R-M).

<4. Production of Developer B-7>

A developer B-7 was produced by the same method as the developer A-1 other than the change described below. The external additive particles used in the production of the toner, which were the resin particles R-A in the production of the developer A-1, were changed to colloidal silica particles having a number average primary particle diameter of 100 nm.

<5. Production of Developer B-8>

A developer B-8 was produced by the same method as the developer A-1 other than the change described below. The carrier mixed with the toner, which was the carrier C-A in the production of the developer A-1, was changed to a carrier C-B. The carrier C-B was produced as described below.

(Production of Carrier C-B)

Uncoated ferrite cores ("EF-35B" manufactured by Powdertech Co., Ltd., the number average primary particle diameter: 35 μm) were used as carrier cores. A carrier-coating-layer formation liquid B was prepared. Specifically, 300 parts by mass of a silicone resin solution ("SR2440" manufactured by Dow Corning Toray Co., Ltd.), 3 parts by mass of a silane coupling agent ("KBM-403" manufactured by Shin-Etsu Chemical Co., Ltd., component: 3-glycidoxypropyltrimethoxysilane), and 300 parts by mass of toluene were mixed and dispersed for 20 minutes using a homomixer. As a result, the carrier-coating-layer formation liquid B was obtained. The carrier-coating-layer formation liquid B had a solid concentration of 50% by mass. Then, 80 parts by mass of the carrier-coating-layer formation liquid B was sprayed toward 1000 parts by mass of the carrier cores using a fluidized bed coating apparatus ("SPIR-A-FLOW (registered Japanese trademark) SFC-5" manufactured by Freund Corporation) while supplying hot air at a temperature of 100° C. As a result, the carrier cores were each covered by an uncured organic layer (fluidized bed). The carrier cores each covered by the uncured organic layer (fluidized bed) were heated for one hour at a temperature of 250° C. using a drier. Through the above, the fluidized bed was cured. As a result, the carrier C-B including the carrier cores each covered by a carrier coating layer (resin layer containing a silicone resin) was obtained.

<6. Evaluation Methods>

Image evaluation was performed by forming images having different coverage rates from one another on paper using each of the developers A-1 to A-7 and B-1 to B-8 and an evaluation apparatus. A color multifunction peripheral ("TASKalfa7551ci" manufactured by KYOCERA Document Solutions Inc., image bearing member: amorphous silicon photosensitive member, developing method: non-magnetic two-component dry touchdown developing method) was used as the evaluation apparatus. A development section of the evaluation apparatus periodically performs the refresh operation (forced toner ejection) during a non-image formation time in a situation in which an image having a coverage rate of 1% is formed. Paper for color/monochrome printing ("$C^2$" manufactured by Fuji Xerox Co., Ltd.) was used as the paper. A two-component developer was loaded into a developing device for cyan. Further, a toner for replenishment use was loaded into a toner container for cyan. The images were formed in an environment at a temperature of 23° C. and a relative humidity of 50%.

(Initial Image Evaluation)

An image N was formed on a sheet of the paper using each of the developers and the evaluation apparatus. The image N included an imaged portion having a coverage rate of 5%, a blank image portion, and a solid image portion. An image density (initial image density) of the solid image portion of the formed image N was measured. Also, a fogging density (initial fogging density) of the blank image portion of the formed image N was measured. Table 2 shows measured values of the initial image density (ID) and the initial fogging density (FD).

(Image Evaluation After Printing Image Having Coverage Rate of 5% on 100,000 Sheets)

The image N was formed on 100,000 sheets of the paper using each of the developers and the evaluation apparatus. The image N included the imaged portion having the coverage rate of 5%, the blank image portion, and the solid image portion. An image density of the solid image portion of the image N formed on the $100,000^{th}$ sheet was measured. A fogging density of the blank image portion of the image N formed on the $100,000^{th}$ sheet was measured. Further, the blank image portion of the image N formed on the $100,000^{th}$ sheet was checked for presence or absence of black spots. Table 2 shows measured values of the image density (ID) and the fogging density (FD), and results of evaluation of presence or absence of black spots.

(Image Evaluation after Printing Image Having Coverage Rate of 1% on 20,000 Sheets)

An image L was formed on 20,000 sheets of the paper using each of the developers and the evaluation apparatus. The image L included an imaged portion having a coverage rate of 1%, a blank image portion, and a solid image portion. An image density of the solid image portion of the image L formed on the $20,000^{th}$ sheet was measured. A fogging density of the blank image portion of the image L formed on the $20,000^{th}$ sheet was measured. Further, the blank image portion of the image L formed on the $20,000^{th}$ sheet was checked for presence or absence of black spots. Subsequently, after the printing on the 20,000 sheets, the surface of the image bearing member was observed with unaided eyes to check for presence or absence of external additive particles adhered to the surface of the image bearing member (presence or absence of adhesion thereof to the drum). Note that in a situation in which an external additive adheres to the surface of the image bearing member, an image defect such as generation of white spots tends to be caused in a formed image. Table 3 shows measured values of the image density (ID) and the fogging density (FD), and evaluation results of presence or absence of black spots and adhesion to the drum.

(Image Evaluation After Printing Image Having Coverage Rate of 50% on 10,000 Sheets)

An image H was formed on 10,000 sheets of the paper using each of the developers and the evaluation apparatus. The image H included an imaged portion having a coverage rate of 50%, a blank image portion, and a solid image portion. An image density of the solid image portion of the image H formed on the 10,000$^{th}$ sheet was measured. A fogging density of the blank image portion of the image H formed on the 10,000$^{th}$ sheet was measured. Further, the blank image portion of the image H formed on the 10,000$^{th}$ sheet was checked for presence or absence of black spots. Table 4 shows measured values of the image density (ID) and the fogging density (FD), and results of evaluation of presence or absence of black spots.

(Measurement of Image Density)

An image density of a solid image portion was measured using a reflectance densitometer ("RD914" manufactured by X-Rite Inc.). A developer was determined to be acceptable in a situation in which an image formed using the developer had an image density of at least 1.200. A developer was determined to be unacceptable in a situation in which an image formed using the developer had an image density of less than 1.200.

(Measurement of Fogging Density)

An image density of a blank image portion was measured using the reflectance densitometer ("RD914" manufactured by X-Rite Inc.). A value obtained by subtracting an image density of base paper from the image density of the blank image portion was determined to be a fogging density. A developer was determined to be acceptable in a situation in which an image formed using the developer had a fogging density of no greater than 0.008. A developer was determined to be unacceptable in a situation in which an image formed using the developer had a fogging density of greater than 0.008.

(Check for Presence or Absence of Black Spots)

Whether or not black sports were present in a formed image was checked with unaided eyes. Based on a result of the check, presence or absence of black spots was evaluated according to the following evaluation criteria. A developer was determined to be acceptable in a situation in which a result of the evaluation of presence or absence of black spots is A or B indicated below. A developer was determined to be unacceptable in a situation in which a result of the evaluation of presence or absence of black spots is C indicated below.

A: No black spot was observed.

B: One or two black spots were observed.

C: At least three black spots were observed.

TABLE 2

| | | Toner External additive | | Initial | | After printing at coverage rate of 5% on 100,000 sheets | | |
|---|---|---|---|---|---|---|---|---|
| | Developer | particles | Carrier | ID | FD | ID | FD | Black spots |
| Example 1 | A-1 | R-A | C-A | 1.420 | 0.001 | 1.422 | 0.002 | A |
| Example 2 | A-2 | R-B | C-A | 1.422 | 0.001 | 1.425 | 0.002 | A |
| Example 3 | A-3 | R-C | C-A | 1.425 | 0.001 | 1.432 | 0.003 | A |
| Example 4 | A-4 | R-D | C-A | 1.405 | 0.001 | 1.410 | 0.001 | A |
| Example 5 | A-5 | R-E | C-A | 1.435 | 0.001 | 1.423 | 0.004 | A |
| Example 6 | A-6 | R-F | C-A | 1.422 | 0.001 | 1.421 | 0.002 | A |
| Example 7 | A-7 | R-G | C-A | 1.378 | 0.001 | 1.388 | 0.003 | A |
| Comparative example 1 | B-1 | R-H | C-A | 1.421 | 0.001 | 1.422 | 0.005 | A |
| Comparative example 2 | B-2 | R-I | C-A | 1.422 | 0.001 | 1.425 | 0.003 | A |
| Comparative example 3 | B-3 | R-J | C-A | 1.401 | 0.001 | 1.402 | 0.001 | A |
| Comparative example 4 | B-4 | R-K | C-A | 1.438 | 0.001 | 1.435 | 0.002 | A |
| Comparative example 5 | B-5 | R-L | C-A | 1.423 | 0.001 | 1.422 | 0.002 | A |
| Comparative example 6 | B-6 | R-M | C-A | 1.368 | 0.001 | 1.390 | 0.003 | A |
| Comparative example 7 | B-7 | Silica particles | C-A | 1.421 | 0.001 | 1.432 | 0.004 | B |
| Comparative example 8 | B-8 | R-A | C-B | 1.398 | 0.001 | 1.332 | 0.001 | A |

TABLE 3

| | | Toner | | After printing at coverage rate of 1% on 20,000 sheets | | | |
|---|---|---|---|---|---|---|---|
| | Developer | External additive particles | Carrier | ID | FD | Black spots | Adhesion to drum |
| Example 1 | A-1 | R-A | C-A | 1.398 | 0.001 | A | Absent |
| Example 2 | A-2 | R-B | C-A | 1.408 | 0.001 | B | Absent |
| Example 3 | A-3 | R-C | C-A | 1.298 | 0.002 | A | Absent |
| Example 4 | A-4 | R-D | C-A | 1.332 | 0.001 | B | Absent |
| Example 5 | A-5 | R-E | C-A | 1.410 | 0.002 | A | Absent |
| Example 6 | A-6 | R-F | C-A | 1.256 | 0.002 | A | Absent |
| Example 7 | A-7 | R-G | C-A | 1.373 | 0.002 | B | Absent |
| Comparative example 1 | B-1 | R-H | C-A | 1.256 | 0.003 | A | Present |
| Comparative example 2 | B-2 | R-I | C-A | 1.410 | 0.001 | C | Absent |
| Comparative example 3 | B-3 | R-J | C-A | 1.330 | 0.001 | C | Absent |
| Comparative example 4 | B-4 | R-K | C-A | 1.411 | 0.002 | A | Absent |
| Comparative example 5 | B-5 | R-L | C-A | 1.189 | 0.002 | A | Absent |
| Comparative example 6 | B-6 | R-M | C-A | 1.385 | 0.003 | C | Absent |
| Comparative example 7 | B-7 | Silica particles | C-A | 1.412 | 0.003 | C | Absent |

TABLE 3-continued

| | Developer | Toner External additive particles | Carrier | After printing at coverage rate of 1% on 20,000 sheets ID | FD | Black spots | Adhesion to drum |
|---|---|---|---|---|---|---|---|
| Comparative example 8 | B-8 | R-A | C-B | 1.003 | 0.002 | A | Absent |

TABLE 4

| | Developer | Toner External additive particles | Carrier | After printing at coverage rate of 50% on 10,000 sheets ID | FD | Black spots |
|---|---|---|---|---|---|---|
| Example 1 | A-1 | R-A | C-A | 1.432 | 0.002 | A |
| Example 2 | A-2 | R-B | C-A | 1.442 | 0.004 | B |
| Example 3 | A-3 | R-C | C-A | 1.444 | 0.006 | A |
| Example 4 | A-4 | R-D | C-A | 1.421 | 0.002 | B |
| Example 5 | A-5 | R-E | C-A | 1.433 | 0.007 | A |
| Example 6 | A-6 | R-F | C-A | 1.433 | 0.002 | A |
| Example 7 | A-7 | R-G | C-A | 1.388 | 0.004 | B |
| Comparative example 1 | B-1 | R-H | C-A | 1.445 | 0.006 | A |
| Comparative example 2 | B-2 | R-I | C-A | 1.432 | 0.006 | C |
| Comparative example 3 | B-3 | R-J | C-A | 1.410 | 0.001 | C |
| Comparative example 4 | B-4 | R-K | C-A | 1.443 | 0.009 | A |
| Comparative example 5 | B-5 | R-L | C-A | 1.432 | 0.002 | A |
| Comparative example 6 | B-6 | R-M | C-A | 1.392 | 0.006 | C |
| Comparative example 7 | B-7 | Silica particles | C-A | 1.445 | 0.009 | C |
| Comparative example 8 | B-8 | R-A | C-B | 1.378 | 0.003 | A |

The developers A-1 to A-7 each included a toner including a plurality of toner particles and a carrier including a plurality of carrier particles. The carrier particles each included a carrier core and a carrier coating layer covering the carrier core. The carrier coating layer contained a fluorine-containing resin. The toner particles each included a toner mother particle and a plurality of resin particles located on the surface of the toner mother particle. The resin particles had a number average primary particle diameter of at least 70 nm and no greater than 200 nm. A dispersion obtained by dispersing 0.1 g of the resin particles in 100 mL of distilled water had an electrical conductivity of at least 2.5 μS/m and no greater than 6.0 μS/m. The resin particles had a degree of aggregation $Y_{160}$ of at least 15% by mass and no greater than 40% by mass. Therefore, as shown in Tables 2 to 4, excellent image density was achieved and occurrence of fogging and generation of black spots were inhibited through use of the developers A-1 to A-7, in all of an initial image, an image formed after printing an image having a coverage rate of 5% on 100,000 sheets, an image formed after printing an image having a coverage rate of 1% on 20,000 sheets, and an image formed after printing an image having a coverage rate of 50% on 10,000 sheets. Further, adhesion of external additive particles to the image bearing member was inhibited through use of the developers A-1 to A-7.

The resin particles in the developer B-1 had a degree of aggregation $Y_{160}$ of greater than 40% by mass. Therefore, external additive particles (resin particles) adhered to the image bearing member through use of the developer B-1, as shown in Table 3.

The resin particles in the developer B-2 had a degree of aggregation $Y_{160}$ of less than 15% by mass. Therefore, as shown in Tables 3 and 4, at least three black spots were generated through use of the developer B-2, in an image formed after printing an image having a coverage rate of 1% on 20,000 sheets and an image formed after printing an image having a coverage rate of 50% on 10,000 sheets.

A dispersion of the resin particles in the developer B-3 had an electrical conductivity of less than 2.5 μS/m. Therefore, as shown in Tables 3 and 4, at least three black spots were generated through use of the developer B-3, in an image formed after printing an image having a coverage rate of 1% on 20,000 sheets and an image formed after printing an image having a coverage rate of 50% on 10,000 sheets.

A dispersion of the resin particles in the developer B-4 had an electrical conductivity of greater than 6.0 μS/m. Therefore, as shown in Table 4, an image formed using the developer B-4 after printing an image having a coverage rate of 50% on 10,000 sheets had a fogging density of greater than 0.008 and suffered from fogging.

The resin particles in the developer B-5 had a number average primary particle diameter of less than 70 nm. Therefore, as shown in Table 3, an image formed using the developer B-5 after printing an image having a coverage rate of 1% on 20,000 sheets had a low image density of less than 1.200.

The resin particles in the developer B-6 had a number average primary particle diameter of greater than 200 nm. Therefore, as shown in Tables 3 and 4, at least three black spots were generated through use of the developer B-6, in an image formed after printing an image having a coverage rate of 1% on 20,000 sheets and an image formed after printing an image having a coverage rate of 50% on 10,000 sheets.

In the developer B-7, silica particles, rather than resin particles, were located on the surface of each toner mother particle. Therefore, as shown in Tables 3 and 4, at least three black spots were generated through use of the developer B-7, in an image formed after printing an image having a coverage rate of 1% on 20,000 sheets and an image formed after printing an image having a coverage rate of 50% on 10,000 sheets. Further, the image formed using the developer B-7 after printing an image having a coverage rate of 50% on 10,000 sheets had a fogging density of greater than 0.008 and suffered from fogging.

The developer B-8 included the carrier C-B. However, the carrier C-B did not contain a fluorine-containing resin in the carrier coating layer. Therefore, as shown in Table 3, an image formed using the developer B-8 after printing an image having a coverage rate of 1% on 20,000 sheets had a low image density of less than 1.200. This is presumably because the toner was excessively charged through carrier particles each including the carrier coating layer formed from a silicone resin.

What is claimed is:

1. A developer comprising a toner and a carrier, wherein the carrier includes a plurality of carrier particles, the carrier particles each include a carrier core and a carrier coating layer covering the carrier core, the carrier coating layer contains a fluorine-containing resin, the toner includes a plurality of toner particles, the toner particles each include a toner mother particle and a plurality of resin particles located on a surface of the toner mother particle, the resin particles have a number average primary particle diameter of at least 70 nm and no greater than 200 nm, a dispersion obtained by dispersing 0.1 g of the resin particles in 100 mL of distilled water has an electrical conductivity of at least 2.5 μS/m and no greater than 6.0 μS/m, and a degree of aggregation $Y_{160}$ of the resin particles represented by expression (1) shown below is at least 15% by mass and no greater than 40% by mass, $$Y_{160}=100\times M_{160A}/M_{160B} \quad (1)$$

in the expression (1), $M_{160B}$ represents a mass of the resin particles to which a pressure of 0.1 kgf/mm$^2$ has been applied at a temperature of 160° C. for five minutes, and $M_{160A}$ represents a mass of the resin particles that remain on a sieve having openings of 75 μm after being subjected to the application of the pressure of 0.1 kgf/mm$^2$ at the temperature of 160° C. for five minutes and then separated using the sieve.

2. The developer according to claim 1, wherein the resin particles contain a copolymer of an acrylic acid or an acrylic acid derivative, styrene or a styrene derivative, and a cross-linking agent.

3. The developer according to claim 2, wherein an amount of the cross-linking agent is at least 35 parts by mass and no greater than 85 parts by mass relative to 100 parts by mass of the acrylic acid or the acrylic acid derivative.

4. The developer according to claim 1, wherein the fluorine-containing resin is a copolymer of tetrafluoroethylene and perfluoroalkyl vinyl ether.

5. The developer according to claim 1, wherein the carrier coating layer further contains a polyamide-imide resin.

6. An image forming apparatus, comprising:

an image bearing member that bears a toner image; and a development section that performs development of an electrostatic latent image formed on a surface of the image bearing member into the toner image by supplying the toner included in the developer according to claim 1 to the electrostatic latent image, wherein the image bearing member is an amorphous silicon photosensitive member.

7. The image forming apparatus according to claim 6, wherein the development section ejects the toner to the image bearing member while not performing the development.

8. An image forming method, comprising developing, by a development section, an electrostatic latent image formed on a surface of an image bearing member into a toner image by supplying the toner included in the developer according to claim 1 to the electrostatic latent image, wherein the image bearing member is an amorphous silicon photosensitive member.

9. The image forming method according to claim 8, further comprising ejecting, by the development section, the toner to the image bearing member while not performing the developing.

* * * * *